US008737855B2

(12) United States Patent
Uchidate et al.

(10) Patent No.: US 8,737,855 B2
(45) Date of Patent: May 27, 2014

(54) IMAGE FORMING APPARATUS AND DENSITY UNEVENNESS DETECTION METHOD

(75) Inventors: Hikaru Uchidate, Yokohama (JP); Tomoyuki Saiki, Suntou-gun (JP); Tae Matsumoto, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 327 days.

(21) Appl. No.: 12/891,336

(22) Filed: Sep. 27, 2010

(65) Prior Publication Data

US 2011/0076040 A1 Mar. 31, 2011

(30) Foreign Application Priority Data

Sep. 29, 2009 (JP) ..... 2009-224827

(51) Int. Cl.
*G03G 15/00* (2006.01)

(52) U.S. Cl.
USPC ..... 399/49; 399/72

(58) Field of Classification Search
USPC ..... 399/49, 72
See application file for complete search history.

(56) References Cited

U.S. PATENT DOCUMENTS

| | | | | |
|---|---|---|---|---|
| 7,283,143 | B2 * | 10/2007 | Mizes et al. | 399/49 |
| 2007/0052991 | A1 * | 3/2007 | Goodman et al. | 358/1.12 |
| 2007/0172257 | A1 * | 7/2007 | Matsuda et al. | 399/301 |
| 2009/0046325 | A1 * | 2/2009 | Paul et al. | 358/3.26 |

FOREIGN PATENT DOCUMENTS

JP 2007-108246 A 4/2007

* cited by examiner

*Primary Examiner* — Ryan Walsh
(74) *Attorney, Agent, or Firm* — Canon U.S.A., Inc. IP Division

(57) ABSTRACT

A plurality of test patches each including a dark and light image which has density unevenness of a predetermined period in which the plurality of test patches are differentiated in phase difference relative to a phase of density unevenness induced by rotational unevenness occurring at a predetermined period in the motor for driving a photosensitive drum is formed. Then, density information of the plurality of test patches with is detected by a density sensor 41, and the phase of the density unevenness is obtained based on detection results (density information) of the plurality of test patches as well as based on a phase difference corresponding to a test patch whose density unevenness is a predetermined value in amplitude.

14 Claims, 26 Drawing Sheets

DENSITY INFORMATION
PROCESSING UNIT 25

FG SIGNAL
PROCESSING UNIT 26

TIMING CHART OF PHASE INFORMATION (FG SIGNAL) INITIALIZATION PROCESSING

TIMING CHART OF TEST PATCH EXPOSURE

AVERAGE ERROR: 93.6°
MAXIMUM ERROR: 162.8°
CORRELATION COEFFICIENT: 0.76

AVERAGE ERROR: 22.4°
MAXIMUM ERROR: 40.5°
CORRELATION COEFFICIENT: 0.97

TABLE 1401

| PG SIGNAL COUNT (PHASE) | BANDING PHASE [ ° ] |
|---|---|
| 0 | 300 |
| 1 | 311.25 |
| 2 | 322.5 |
| 3 | 333.75 |
| 4 | 345 |
| 5 | 356.25 |
| 6 | 7.5 |
| 7 | 18.75 |
| 8 | 30 |
| ... | ... |
| 30 | 277.5 |
| 31 | 288.75 |

TABLE 1402

| PG SIGNAL COUNT (PHASE) | BANDING WAVEFORM |
|---|---|
| 0 | -0.866 |
| 1 | -0.752 |
| 2 | -0.609 |
| 3 | -0.442 |
| 4 | -0.259 |
| 5 | -0.065 |
| 6 | 0.131 |
| 7 | 0.321 |
| 8 | 0.500 |
| ... | ... |
| 30 | -0.991 |
| 31 | -0.947 |

TABLE 1403

| PG SIGNAL COUNT (PHASE) | INVERSED BANDING CHARACTERISTICS |
|---|---|
| 0 | 0.866 |
| 1 | 0.752 |
| 2 | 0.609 |
| 3 | 0.442 |
| 4 | 0.259 |
| 5 | 0.065 |
| 6 | -0.131 |
| 7 | -0.321 |
| 8 | -0.500 |
| ... | ... |
| 30 | 0.991 |
| 31 | 0.947 |

TABLE 1404

| PG SIGNAL COUNT (PHASE) | CORRECTION INFORMATION |
|---|---|
| 0 | 0.979 |
| 1 | 0.982 |
| 2 | 0.985 |
| 3 | 0.989 |
| 4 | 0.994 |
| 5 | 0.998 |
| 6 | 1.003 |
| 7 | 1.008 |
| 8 | 1.013 |
| ... | ... |
| 30 | 0.976 |
| 31 | 0.977 |

TIMING CHART OF EXPOSURE

TIMING CHART OF TEST PATCH EXPOSURE

TIMING CHART OF READING PROCESSING OF W1 DETECTION TEST PATCH

FIG.21A

W1

| W1FG SIGNAL COUNT (PHASE) | DENSITY VALUE |
|---|---|
| 0 | 2.213 |
| 1 | 2.225 |
| 2 | 2.239 |
| 3 | 2.256 |
| 4 | 2.274 |
| 5 | 2.293 |
| 6 | 2.313 |
| 7 | 2.332 |
| 8 | 2.350 |
| . . . | . . . |
| 30 | 2.201 |
| 31 | 2.205 |

TABLE 2101

CALCULATE DIFFERENCE FROM AVERAGE DENSITY

| W1FG SIGNAL COUNT (PHASE) | DENSITY UNEVENNESS INFORMATION |
|---|---|
| 0 | -0.087 |
| 1 | -0.075 |
| 2 | -0.061 |
| 3 | -0.044 |
| 4 | -0.026 |
| 5 | -0.007 |
| 6 | 0.013 |
| 7 | 0.032 |
| 8 | 0.050 |
| . . . | . . . |
| 30 | -0.099 |
| 31 | -0.095 |

TABLE 2102

FIG.21B

W4

| W1FG SIGNAL COUNT (PHASE) | W4 BANDING PHASE [°] |
|---|---|
| 0 | 90 |
| 1 | 135 |
| 2 | 180 |
| 3 | 225 |
| 4 | 270 |
| 5 | 315 |
| 6 | 360 |
| 7 | 45 |
| 8 | 90 |
| . . . | . . . |
| 30 | 360 |
| 31 | 45 |

TABLE 2103

CALCULATE NORMALIZED SINE WAVE (AMPLITUDE = 1) BASED ON DENSITY UNEVENNESS PHASE

| W1FG SIGNAL COUNT (PHASE) | W4 BANDING CHARACTERISTICS |
|---|---|
| 0 | 1.000 |
| 1 | 0.707 |
| 2 | 0.000 |
| 3 | -0.707 |
| 4 | -1.000 |
| 5 | -0.707 |
| 6 | 0.000 |
| 7 | 0.707 |
| 8 | 1.000 |
| . . . | . . . |
| 30 | 0.000 |
| 31 | 0.707 |

TABLE 2104

CALCULATE W4 DENSITY UNEVENNESS INFORMATION BY MULTIPLYING W4 BANDING AMPLITUDE HAVING BEEN SET

| W1FG SIGNAL COUNT (PHASE) | W4 DENSITY UNEVENNESS INFORMATION |
|---|---|
| 0 | 0.100 |
| 1 | 0.071 |
| 2 | 0.000 |
| 3 | -0.071 |
| 4 | -0.100 |
| 5 | -0.071 |
| 6 | 0.000 |
| 7 | 0.071 |
| 8 | 0.100 |
| . . . | . . . |
| 30 | 0.000 |
| 31 | 0.071 |

TABLE 2105

FIG.21C

SUM OF W1 AND W4 DENSITY UNEVENNESS INFORMATION

| W1FG SIGNAL COUNT (PHASE) | SUMMED-UP DENSITY UNEVENNESS INFORMATION |
|---|---|
| 0 | 0.013 |
| 1 | -0.004 |
| 2 | -0.061 |
| 3 | -0.115 |
| 4 | -0.126 |
| 5 | -0.077 |
| 6 | 0.013 |
| 7 | 0.103 |
| 8 | 0.150 |
| . . . | . . . |
| 30 | -0.099 |
| 31 | -0.024 |

TABLE 2106

CALCULATE INVERSED CHARACTERISTICS OF SUMMED-UP DENSITY UNEVENNESS INFORMATION

| W1FG SIGNAL COUNT (PHASE) | INVERSED BANDING CHARACTERISTICS |
|---|---|
| 0 | -0.013 |
| 1 | 0.004 |
| 2 | 0.061 |
| 3 | 0.115 |
| 4 | 0.126 |
| 5 | 0.077 |
| 6 | -0.013 |
| 7 | -0.103 |
| 8 | -0.150 |
| . . . | . . . |
| 30 | 0.099 |
| 31 | 0.024 |

TABLE 2107

CALCULATE CORRECTION INFORMATION BASED ON INVERSED BANDING CHARACTERISTICS

| W1FG SIGNAL COUNT (PHASE) | DENSITY CORRECTION INFORMATION |
|---|---|
| 0 | 1.006 |
| 1 | 0.998 |
| 2 | 0.974 |
| 3 | 0.952 |
| 4 | 0.948 |
| 5 | 0.968 |
| 6 | 1.006 |
| 7 | 1.047 |
| 8 | 1.070 |
| . . . | . . . |
| 30 | 0.959 |
| 31 | 0.990 |

TABLE 2108

IMAGE FORMING APPARATUS AND DENSITY UNEVENNESS DETECTION METHOD

BACKGROUND OF THE INVENTION

1. Field of the Invention

The present invention relates to an image quality stabilization technique for an image forming apparatus.

2. Description of the Related Art

There are a wide variety of image forming apparatuses, such as electro-photographic printers and inkjet printers. These image forming apparatuses are required to maintain a predetermined level of image quality. One of the factors that induce reduction in image quality is density unevenness (referred to as banding) in a sheet conveyance direction (i.e., a sub scanning direction). In view of the foregoing problem, a conventional technique discussed in Japanese Patent Application Laid-Open No. 2007-108246 discusses eliminating unevenness in the density occurring in the sub scanning direction.

The following contents are discussed in Japanese Patent Application Laid-Open No. 2007-108246. First, a density sensor detects a density unevenness value in the sub scanning direction, beforehand. The density unevenness is a phenomenon that is induced at a period corresponding to an outer diameter of a photosensitive drum. The detected density unevenness is associated with a phase of the photosensitive drum and stored as data of a density pattern information table in a storage unit.

The discussed technique further includes reading, during an image forming operation, density unevenness information corresponding to the phase of the photosensitive drum from the table. Then, the density unevenness occurring at the period corresponding to the outer diameter of the photosensitive drum is corrected based on the read density unevenness information.

A study on the above described banding phenomenon conducted by the applicant of this application has revealed that unevenness in rotation of a motor that drives the photosensitive drum is one of the factors that induce the density unevenness (i.e., banding) in the sub scanning direction.

More specifically, rotational unevenness occurs in the motor when it is rotating due to inherent structural features of the motor, such as the number of magnetized poles. Further, the rotational unevenness occurring in the motor induces unevenness in density. The density unevenness deteriorates an image in quality. At this point, the density unevenness induced by the rotational unevenness occurring in the motor includes relatively higher frequency components. Therefore, to eliminate the density unevenness, it is necessary to detect relatively the higher-frequency components.

However, if an optical sensor is used to read a density value of a test patch toner image in an unfixed state, for example, formed on an intermediate transfer member, detection of density unevenness including relatively higher-frequency components may not be accurately performed. More specifically, in a case where an effective diameter of a light detection area of a light receiving element of the optical sensor is not sufficiently small compared to the length of one period of the density unevenness, the detection cannot be accurately performed as understood from FIGS. 22A and 22B.

FIG. 22A illustrates an example case in which the diameter of a light detection area of the light receiving element on an intermediate transfer member is sufficiently small compared to the length of one period of the density unevenness. In this case, the density sensor can accurately read a phase of the density unevenness.

FIG. 22B illustrates another example case in which the diameter of a light detection area of the light receiving element on the intermediate transfer member is larger than the length of one period of the density unevenness. In this case, a higher density portion is always positioned in the light detection area of the light receiving element. A measured amplitude value of the density variation (intensity information of density variation) becomes smaller due to a detection result averaging effect. The phase of density variation may change. As a result, the detection deteriorates in accuracy.

In particular, the phase of density variation is very important as a parameter in performing correction of the density unevenness. If the density correction is performed based on an erroneously detected phase of density unevenness, the image quality is not so improved or may be rather deteriorated.

SUMMARY OF THE INVENTION

The present invention is directed to a technique capable of accurately detecting information relating to density unevenness even in a case where a diameter of a light detection area of a light receiving element of an optical sensor is not sufficiently small compared to a length of one period of the density unevenness.

According to an aspect of the present invention, an image forming apparatus includes an image forming unit which includes a photosensitive member that is driven by a motor and is configured to perform image forming based on an exposure to the photosensitive member by an exposure unit, a detection unit configured to detect density information when a test patch formed by the image forming unit is irradiated with light, a test patch formation instruction unit configured to cause the image forming unit to form a plurality of test patches each including a dark and light image which has density unevenness of a predetermined period in which the plurality of test patches are differentiated in phase difference relative to a phase of density unevenness, as density unevenness of an image in a sub scanning direction, induced by rotational unevenness occurring at the predetermined period in the motor, and a control unit configured to obtain the phase of the density unevenness based on density information of the plurality of test patches detected by the detection unit as well as based on an intensity of a density variation and the phase difference with respect to the density information of anyone of the plurality of test patches.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 21A to 21C illustrates an example of exposure output correction tables that can be used to correct banding according to the phase of rotational unevenness occurring in the motor.

DESCRIPTION OF THE EMBODIMENTS

Preferred embodiments of the present invention will now be illustrated. The individual embodiments described below will be helpful in understanding a variety of concepts of the present invention from the generic to the more specific. Further, the technical scope of the present invention is defined by the claims, and is not limited by the following individual embodiments.

[An Embodiment to Implement the Invention]

Example processing for detecting density unevenness, in a case where the diameter of a light detection area of a light receiving element of an optical sensor is not sufficiently small compared to the length of one period of the density unevenness, is described below with reference to the attached drawings. However, constituent components described in the present exemplary embodiment are mere examples. Therefore, the scope of the present invention should not be narrowly limited to the illustrated configuration. Further, as an actual example, a detection result of the density unevenness can be used for banding correction. However, the present invention is not limited to the banding correction only. According to the present exemplary embodiment, the density unevenness detection itself is novel in characteristic features.

[A Cross-Sectional View Illustrating an Image Forming Apparatus]

Figure 1:
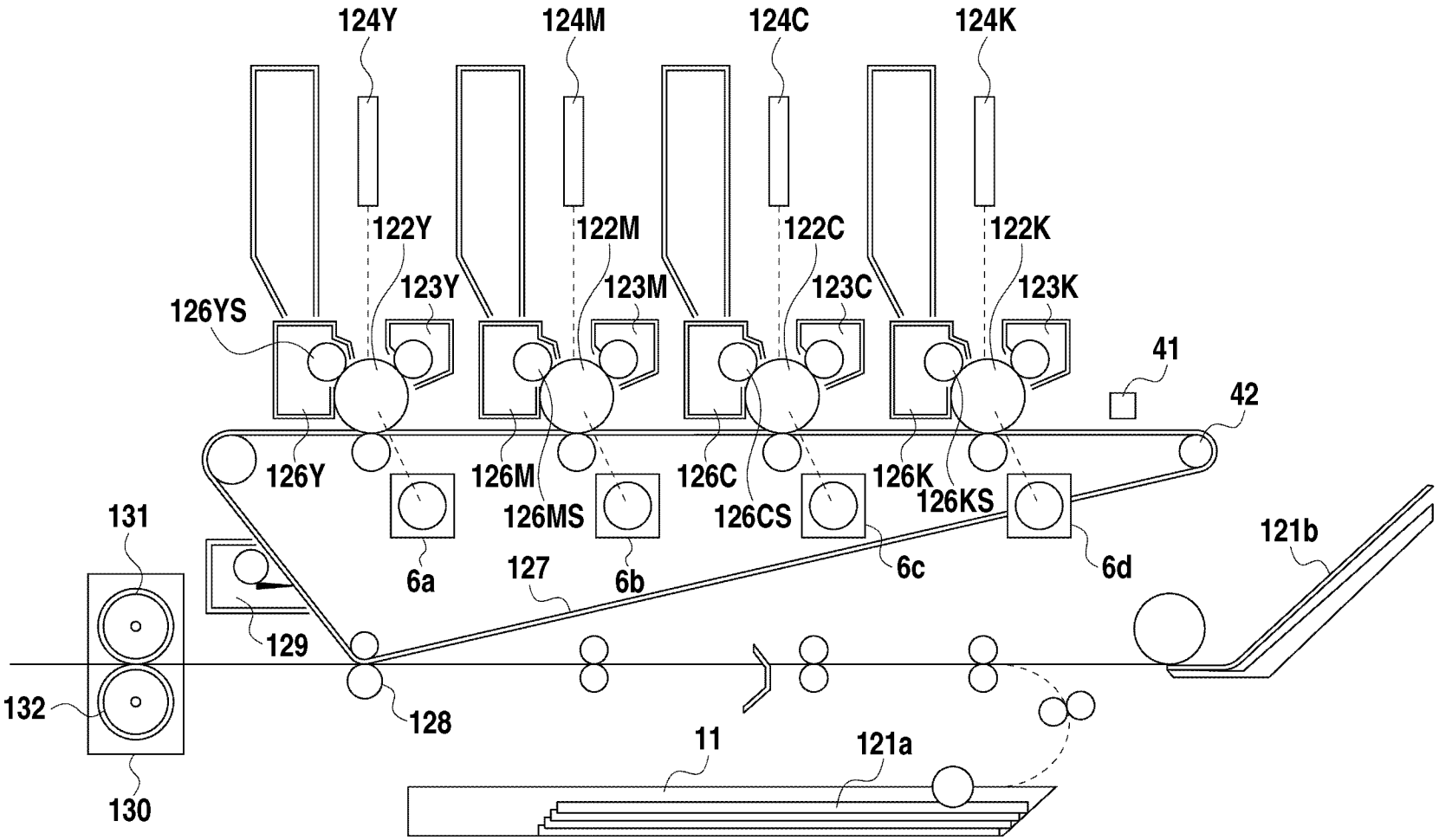
FIG. 1 is a cross-sectional view illustrating a color image forming apparatus according to an exemplary embodiment of the present invention.

FIG. 1 is a cross-sectional view illustrating a color image forming apparatus according to an exemplary embodiment of the present invention. The color image forming apparatus illustrated in FIG. 1 performs sequential processing, which includes forming an electrostatic latent image with exposure light (e.g., a laser beam) that is on-off controlled based on image information supplied from an image processing unit (not illustrated in FIG. 1) and developing the electrostatic latent image to form a monochrome toner image of each color. The sequential processing further includes combining a plurality of monochrome toner images of respective colors, transferring the combined toner image to a transfer member 11, and fixing the multi-color toner image on the transfer member 11. The above described sequential processing is described below in more detail.

The transfer member 11 can be fed from a sheet feeding unit 121*a* or a sheet feeding unit 121*b*. Four sequentially disposed photosensitive drums (i.e., electro-photographic photosensitive members) 122Y, 122M, 122C, and 122K can rotate in the sub scanning direction when the driving force is transmitted from driving motors 6*a* to 6*d* to the photosensitive drums 122Y, 122M, 122C, and 122K via a driving voltage device (e.g., a gear train).

Each injection charging device 123 can charge the photosensitive member. Four injection charging devices 123Y, 123M, 123C, and 123K are differentiated in color so as to correspond to yellow (Y), magenta (M), cyan (C), and black (K), respectively. Each of scanner units 124Y, 124M, 124C, and 124K performs a scanning operation in the main scanning direction. Through the scanning operation, each scanner unit selectively exposes the surface of a corresponding one of the photosensitive drums 122Y, 122M, 122C, and 122K to form an electrostatic latent image by irradiating the drum surface with exposure light.

Each of the photosensitive drums 122Y to 122K is rotatable around its rotational shaft with a certain amount of eccentricity. At a time when an electrostatic latent image is formed, a phase relationship among the respective photosensitive drums 122Y to 122K is already adjusted in such a manner that eccentric influences on a transfer unit are substantially equalized among respective drums. Alternatively, it is useful to perform a motor control for suppressing a variation in a rotational speed of the photosensitive drum in a case where the variation has been induced by the eccentric component, so as to reduce color misregistrations. Each developing device 126 can develop an electrostatic latent image with a color toner supplied from a toner cartridge, to visualize the electrostatic latent image. Four developing devices 126Y, 126M, 126C, and 126K correspond to yellow (Y), magenta (M), cyan (C), and black (K), respectively. Sleeves 126YS, 126MS, 126CS, and 126KS are respectively provided in the corresponding developing devices.

A belt-like intermediate transfer member 127 can contact respective photosensitive drums 122Y, 122M, 122C, and 122K while the intermediate transfer member 127 is rotating for scanning in the sub scanning direction. Then, under transfer member electricities 33Y, 33M, 33C, and 33K, the monochrome toner images are transferred from the photosensitive drums 122Y, 122M, 122C, and 122K to the intermediate transfer member 127 in such a manner that the toner images are overlapped with each other.

Subsequently, a transfer roller 128, which is described below, contacts the intermediate transfer member 127. The transfer member 11 is sandwiched between transfer roller 128 and the intermediate transfer member 127, and is conveyed in a predetermined direction. The multi-color toner image is transferred from the intermediate transfer member 127 to the transfer member 11. A fixing device 130 is capable of heating, fusing, and fixing the transferred multi-color toner images while conveying the transfer member 11. As illustrated in FIG. 1, the fixing device 130 includes a fixing roller 131 that can heat the transfer member 11 and a pressing roller 132 that can press the transfer member 11 against the fixing roller 131. A discharge roller (not illustrated) discharges the transfer member 11 to a discharge tray (not illustrated) in a state where the toner image is fixed to the transfer member 11, thereby terminating the image forming operation. A cleaning device 129 can remove residual toners off the surface of the intermediate transfer member 127.

[A Configuration of a Density Sensor 41]

A density sensor 41, which may be referred to as an optical density detection sensor 41, is disposed in the image forming apparatus illustrated in FIG. 1 to face the intermediate transfer member 127. The density sensor 41 can measure an optical density of a test patch formed as a toner image on the surface of the intermediate transfer member 127. The density sensor 41 scans the test patch in the sub scanning direction while the intermediate transfer member 127 is traveling. Therefore, the sensor 41 can detect a density distribution of the patch in the sub scanning direction.

The rotational direction of each photosensitive drum, the conveyance direction of the transfer member, and the rotational direction of the intermediate transfer member are perpendicular to a direction corresponding to the main scanning direction of an image. In the following description, the direction perpendicular to the main scanning direction may be referred to as the conveyance direction or the sub scanning direction.

The color image forming apparatus illustrated in FIG. 1 includes the intermediate transfer member 127. The present invention can be also applied to a primary transfer type image forming apparatus that can directly transfer a toner image developed on the photosensitive drum 122 to a recording material. In this case, the intermediate transfer member 127 in the following description should be replaced with a transfer member conveyance belt (i.e., a transfer member carrier). Further, as apparent from the cross-sectional view illustrated in FIG. 1, each photosensitive drum 122 is equipped with a motor 6 (i.e., a driving device). However, the motor 6 can be commonly used to drive a plurality of photosensitive drums. For example, four photosensitive drums 122Y, 122M, 122C, and 122K can be driven by a single motor 6.

Figure 2A:
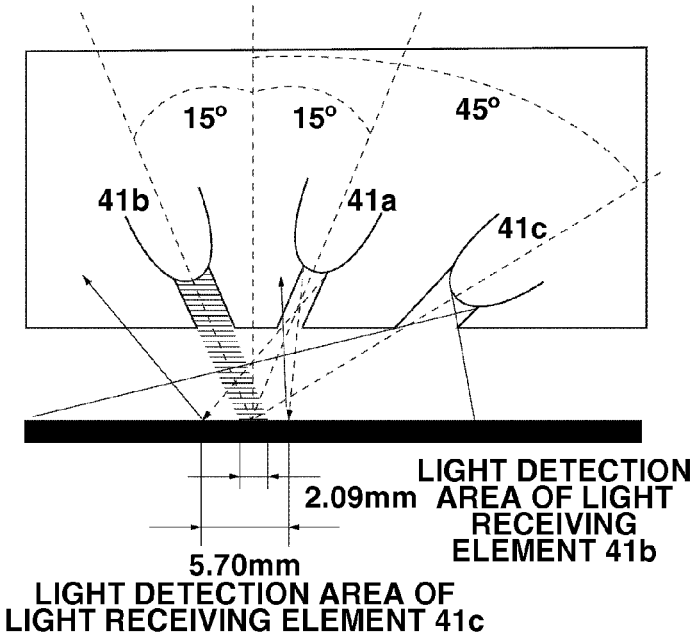
FIGS. 2A to 2C illustrate an optical sensor according to an exemplary embodiment of the present invention.

Next, the density sensor 41 is described below in more detail with reference to FIG. 2. The density sensor 41, as illustrated in FIG. 2A, includes a light emitting element 41*a* (e.g., a light emitting diode (LED)) that can generate an infrared ray having a wavelength of 950 nm, two light receiving elements 41*b* and 41*c* each being constructed by a photodiode, and a holder. The intermediate transfer member 127 and a test patch formed on the intermediate transfer member 127 are irradiated with the infrared ray emitted from the light emitting element 41*a*. The light receiving elements 41*b* and 41*c* can detect reflection light from the intermediate transfer member 127 or the test patch formed thereon.

In this case, the reflection light from the test patch includes regular reflection components and irregular reflection components. The light receiving element 41*b* is configured to detect both the regular reflection components and the irregular reflection components. The light receiving element 41*c* is configured to detect only the irregular reflection components. In the present exemplary embodiment, for example, a light detection area (i.e., a portion indicated by hatching lines) of the light receiving element 41*b* has a diameter of 2.09 mm on the intermediate transfer member. A corresponding light detection area of the light receiving element 41*b* has a diameter of 5.7 mm on the intermediate transfer member. The above described arrangement of the density sensor 41 enables to observe a state of the intermediate transfer member 127 and measure the density of a toner image based on both the detected regular reflection components and the irregular reflection components, or based on only the irregular reflection components.

Figure 2B:
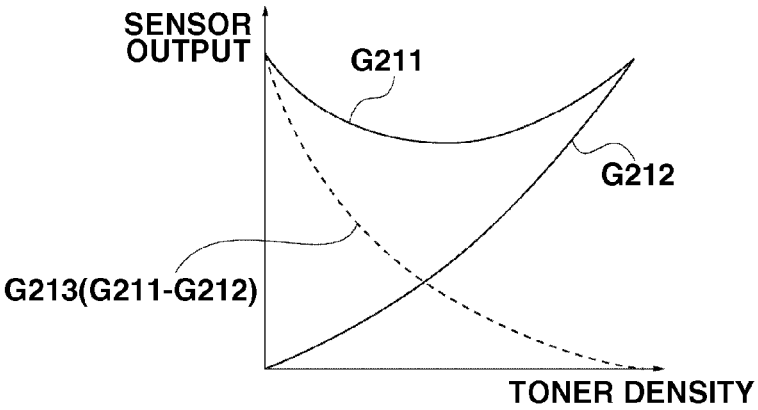

FIG. 2B illustrates a detection result of reflection light detected by the light receiving element 41*b* and the light receiving element 41*c* in a case where a test patch of a chromatic color (e.g., yellow, magenta, and cyan) is formed on the intermediate transfer member 127 and is irradiated with the light from the light emitting element 41*a*. In FIG. 2B, the ordinate axis indicates a sensor output value and the abscissa axis indicates a test patch density corresponding to the sensor output value. As apparent from FIG. 2B, when the toner density increases, an output value G212 of the light receiving element 41*c* that detects the irregular reflection components increases. On the other hand, an output value G211 of the light receiving element 41*b* includes an irregular reflection light component G212 that increases when the toner density increases.

Accordingly, in a case where a detection system is configured to detect irregular reflection components as an index of the density detection, it is useful to obtain a test patch density based on the output value G212 of the light receiving element 41*c*. In a case where the detection system is configured to detect regular reflection components as an index of the density detection, it is useful to obtain a test patch density based on a difference G213 between the output value G211 of the light receiving element 41*b* and the output value G212 of the light receiving element 41*c*. An example system in the following description is configured to detect regular reflection components as an index of the density detection.

Figure 2C:
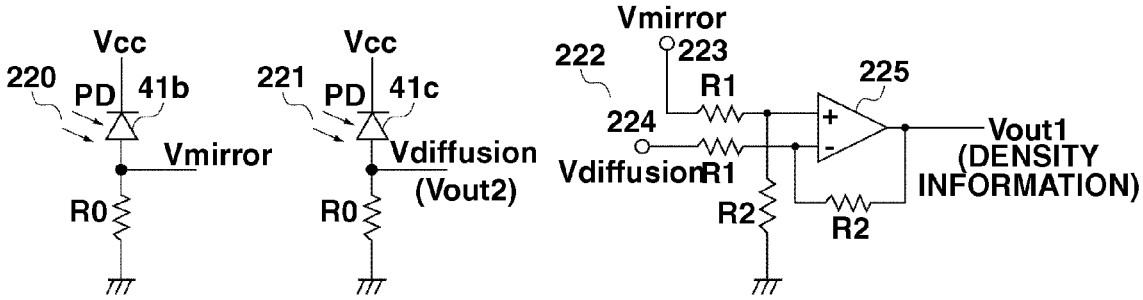

FIG. 2C illustrates a circuit diagram that relates to the light receiving elements 41*b* and 41*c*. A circuit 220 is a light detection circuit dedicated to the light receiving element 41*b*. The circuit 220 includes a register R0 and a photodiode (PD) 41*b*, which can divide a voltage Vcc to generate an output voltage Vmirror. The output voltage Vmirror is supplied to a positive terminal 223 of a circuit 222. A circuit 221 is a light detection circuit dedicated to the light receiving element 41*c*. The circuit 221 is similar to the circuit 220 in configuration. An output voltage Vdiffusion of the circuit 221 is input to a negative terminal 224 of the circuit 222. Further, the output voltage Vdiffusion is directly supplied, as Vout2, to a control unit 21.

The circuit 222 can function as an operational amplifier. The circuit 222 generates an output voltage Vout=R2/R1× (Vmirror−Vdiffusion) which corresponds to the difference G213 that is indicated as a dotted line in FIG. 2B. Then, the output voltage Vout (Vout1 or Vout2) is input to the control unit 21. The control unit 21 performs predetermined calculations to output density information. In the present exemplary embodiment, the detection processing by the density sensor 41 is terminated when the density information is output.

[A Description of a Configuration of a Motor 6]

An example configuration of a motor which is a banding generation source is described below. First, a general configuration of the motor 6 is described below with reference to FIGS. 3A to 3D. Then, an example mechanism of rotational unevenness periodically generated by the motor 6 is described below with reference to FIG. 3E.

[A Description of a General Configuration of a Motor]

Figure 3A:
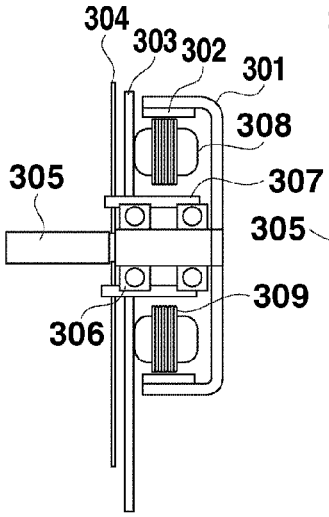
FIGS. 3A to 3E illustrate a hardware configuration of a motor according to an exemplary embodiment of the present invention.
Figure 3B:
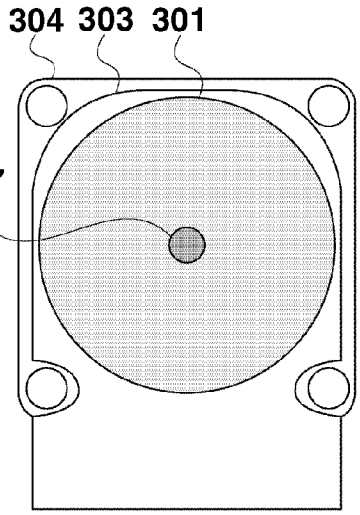
Figure 3C:
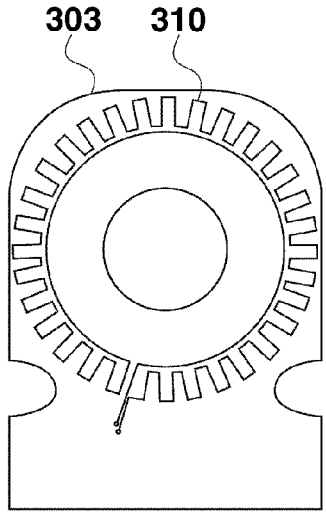

FIG. 3A is a cross-sectional view of the motor 6. FIG. 3B is a front view of the motor 6. FIG. 3C illustrates a circuit substrate 303, which is taken out of the body of the motor 6. The motor 6 corresponds to various motors included in the image forming apparatus, such as the motors 6*a* to 6*d* that can drive the photosensitive drums 122Y to 122K, and a motor 6*e* that can drive a driving roller 42.

In FIGS. 3A and 3B, a rotor magnet 302 is bonded to an inside of a rotor frame 301. The rotor magnet 302 is, for example, a permanent magnet. A coil 309 is wound around each stator 308. A plurality of stators 308 is disposed along a circumferential direction of the rotor frame 301.

A shaft 305 can transmit the rotational force of the motor 6 to an external device. More specifically, the shaft 305 can be mechanically configured into a gear shape. Alternatively, a resin-made gear, which is for example made of polyoxymethylene (POM), can be inserted into the shaft 305 to transmit the rotational force to an opponent gear. A housing 307 which is configured to fix a bearing 306 is engaged with an installation plate 304.

On the other hand, an annular frequency generator (FG) pattern (i.e., a speed detection pattern) 310 is printed on a rotor side surface of the circuit substrate 303, as illustrated in FIG. 3C. The annular FG pattern is disposed to face an FG magnet 311. Further, driving control circuit components (not illustrated) are mounted on the other surface of the circuit substrate 303. For example, the driving control circuit components include a control integrated circuit (IC), a plurality of (e.g., three) hall elements, a register, a capacitor, a diode, a metal oxide semiconductor field effect transistor (MOSFET), and the like. The control IC (not illustrated) is capable of controlling the current to be supplied to the coil, switching the direction of the current, and causing the rotor frame 301 and each part connected to the rotor frame 301 to rotate, based on positional information of the rotor magnet 302 (i.e., a hall device output).

Figure 3D:
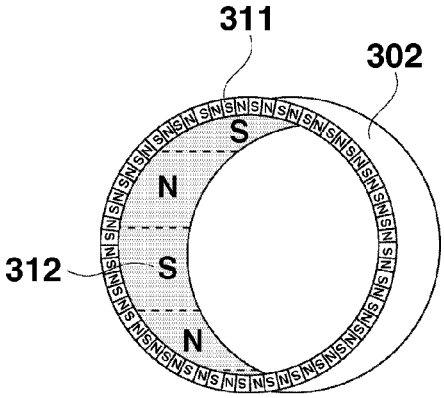

FIG. 3D illustrates the rotor magnet 302 that is taken out of the body of the motor 6. A circumferential surface of the rotor magnet 302 is magnetized (see 312) as illustrated in FIG. 3D. The rotor magnet 302 has an opened end surface where the FG magnet 311 is magnetized. In the present exemplary embodiment, the rotor magnet 302 includes a total of eight poles (four N-poles and four S-poles) that can be magnetized for driving. Further, in an ideal state, the rotor magnet 302 can be magnetized (see 312) at equal intervals so that N-poles and S-poles are alternately magnetized.

On the other hand, the FG magnet 311 includes a plurality of pairs of N and S magnetic poles, the total number of which is greater than the total number of the above described driving use magnetic poles. In the present exemplary embodiment, the number of pairs of N-poles and S-poles of the FG magnet 311 is equal to 32. The FG pattern 310 illustrated in FIG. 3C includes numerous rectangles connected in series to form an annular shape corresponding to the FG magnet 311. The number of the rectangles constituting the FG pattern 310 is equal to the number of the magnetized poles of the FG magnet 311.

The motor illustrated in FIGS. 3A to 3D includes a motor speed sensor of a frequency generator (FG) type which can generate a frequency signal that is proportional to the rotation speed. When the FG magnet 311 rotates integrally with the rotor frame 301, a relative magnetic flux change occurs between the FG pattern 310 and the FG magnet 311. As a result, a sine wave signal having a frequency corresponding to the rotation speed is induced on the FG pattern 310.

The control IC (not illustrated) generates a pulse FG signal based on a comparison between the generated induction voltage and a predetermined threshold value. Then, speed/driving control for the motor 6 and various processing, which is described below in detail, are performed based on the generated FG signal. The motor speed sensor is not limited to the speed generator type. For example, an encoder type speed sensor (e.g., an MR sensor type or a slit plate type) is employable as a motor speed sensor.

Although described below in more detail, rotational unevenness occurring in the motor 6 causes (influences) density unevenness (banding) of an image that occurs periodically. More specifically, a rotational phase of the rotational unevenness occurring in the motor 6 can be used as a parameter in predicting a state where the density unevenness is periodically generated. Thus, the control unit 21 can identify the phase of the rotational unevenness based on the FG signal output from the motor 6.

[A Description of a Mechanism of Rotational Unevenness Occurring in a Motor]

In general, the rotational unevenness occurring at a period corresponding to one complete revolution of the motor 6 is induced by the structure of the motor 6. As a representative example, an actual magnetized state of the rotor magnet 302 (unevenness in magnetization during one complete revolution of the rotor) and a positional deviation between the centers of the rotor magnet 302 and the stator 308 are two main factors that substantially determine the rotational unevenness occurring in the motor 6 at a period of one complete rotation thereof. The above described two factors cause a total motor driving force to change during one rotational period of the motor 6, in a state where the total motor driving force is generated by respective stators 308 and the rotor magnet 302.

Figure 3E:
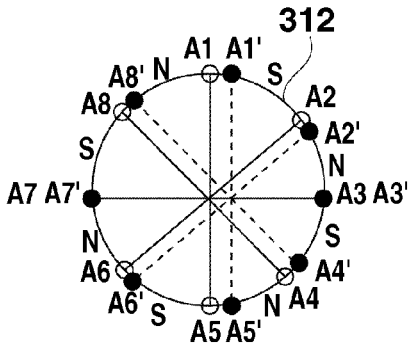

In the present exemplary embodiment, an example variation in magnetization is described below with reference to FIG. 3E. FIG. 3E is a front view illustrating the magnetization 312, in which each of points A1 to A8 and A1' to A8' indicates a boundary where N-poles and S-poles are switched. Each of the points A1 to A8 plotted at equal intervals in the circumferential direction indicates a boundary between the N-pole and the S-pole in the case where no variation is present in the magnetization. On the other hand, each of the points A1' to A8' indicates a boundary between the N-pole and the S-pole in the case where there is a variation in the magnetization.

In addition, eccentricity of the motor shaft (i.e., a pinion gear) 305 is considered to be another factor that induces the rotational unevenness occurring in the motor. The rotational unevenness caused by the eccentricity of the motor shaft is transmitted to an opponent rotating member. The transmitted rotational unevenness appears as density unevenness. The eccentricity of the motor shaft (i.e., the pinion gear) 305 is a kind of rotational unevenness appearing at a period corresponding to one complete revolution of the motor 6. The rotational unevenness caused by the eccentricity of the motor shaft (i.e., the pinion gear) 305 and the above described rotational unevenness caused by the variation in magnetization are combined and transmitted to the photosensitive drum (i.e., a transmission destination of the driving force). The combined rotational unevenness transmitted to the photosensitive drum appears as density unevenness. The above described phenomenon is the representative mechanism of the rotational unevenness occurring at a period corresponding to one complete revolution of the motor 6.

Meanwhile, the motor 6 generates rotational unevenness occurring at a period other than the above described period corresponding to one complete revolution of the motor 6. For example, in a case where the rotor magnet 302 of a motor includes 8-pole magnetized driving magnetic poles, there are a total of four pairs of the N-pole and the S-pole. Therefore, during one complete revolution of the motor 6, each hall device (not illustrated) can detect magnetic flux changes corresponding to four periods.

If the setup position of any one of the hall devices is deviated from an ideal position, a phase relationship between outputs of respective hall devices during one period of magnetic flux change may collapse. In such a case, if an output of each hall device is used in a motor driving control that performs switching of exciting currents to be supplied to the coils wound around the respective stators, the switching timing will shift undesirably. As a result, rotational unevenness having a period equivalent to one fourth (¼) of the period corresponding to one complete revolution of the motor 6 appears four times while the motor 6 rotates 360 degrees. It will be apparent that the rotational unevenness occurs at a period corresponding to the number of driving magnetic poles provided on the rotor magnet 302, which corresponds to an integer multiple in frequency. Further, the generated rotational unevenness induces density unevenness.

[A Block Diagram Illustrating an Overall Hardware Configuration]

Figure 4:
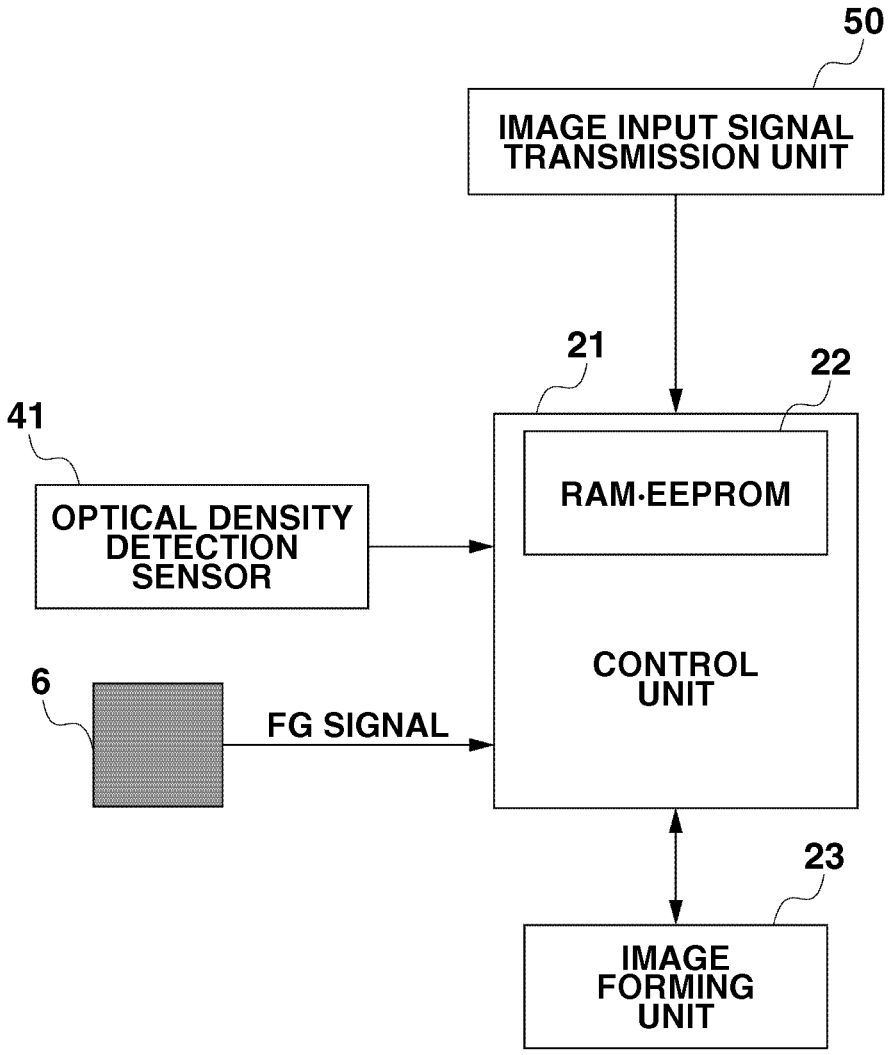
FIG. 4 is a block diagram illustrating an overall configuration of the image forming apparatus according to an exemplary embodiment of the present invention.

FIG. 4 is a block diagram illustrating an overall hardware configuration of the image forming apparatus according to the present exemplary embodiment of the present invention.

The control unit 21 includes a storage unit 22 and is connected to an image forming unit 23 and the density sensor 41. The control unit 21 can control various operations to be performed by the image forming apparatus in association with each unit.

Further, the control unit 21 performs various calculations based on input information. For example, the control unit 21 generates a correlation table which defines a relationship between a rotational phase of the motor and correction information for density correction (banding correction) based on density information output from the density sensor 41 and an FG signal output from the motor 6.

Further, the control unit 21 can control an exposure unit 24 that performs exposure processing based on an image input signal output from an image input signal transmission unit 50. At that time, the control unit 21 causes the exposure unit 24 to perform the exposure processing in synchronization with a phase change of the motor 6 that can be identified based on the FG signal, so that the exposure reflects a density correction result that corresponds to a rotational unevenness phase of the motor 6. The above described operations by the control unit 21 are described below in more detail.

The storage unit 22 includes an electrically erasable programmable read only memory (EEPROM) and a random access memory (RAM). The EEPROM stores a rewritable table that defines a correspondence between a count value that identifies the FG signal and correction information. The count value is usable as phase information of the motor 6. The correction information is usable in image density correction. Further, the EEPROM stores other various setting information relating to image forming control to be performed by the control unit 21.

On the other hand, the RAM of the storage unit 22 can be used to temporarily store information when the control unit 21 performs various processing. The image forming unit 23 represents each member that relates to the image formation described with reference to FIG. 1. More specifically, the image forming unit 23 is an operative member that relates to a toner image formation based on the exposure by the exposure unit 24 which includes each photosensitive drum 122 and the intermediate transfer member 127, although not described in detail. The density sensor 41 has the configuration described with reference to FIG. 2.

[A Hardware Configuration and a Functional Block Diagram]

Figure 5A:
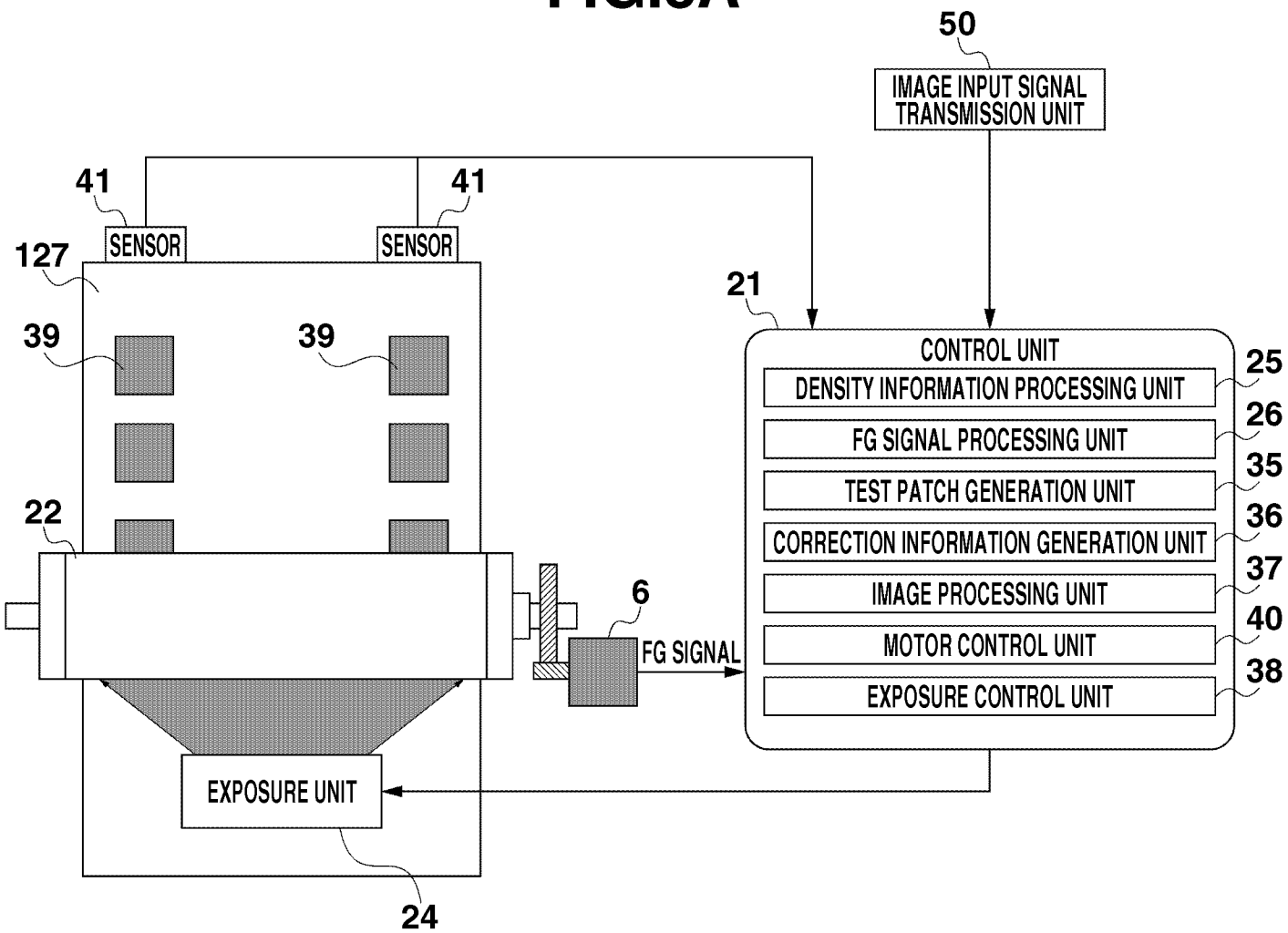
FIGS. 5A to 5C are functional block diagrams according to an exemplary embodiment of the present invention.

FIG. 5A illustrates a part of members constituting the color image forming apparatus, a part of the block diagram illustrated in FIG. 4, and a functional block diagram controlled by the control unit 21. Components or members similar to those described in FIG. 1 or FIG. 4 are denoted by the same reference numerals and detailed descriptions for these components or members are not repeated.

In FIG. 5A, a density information processing unit 25 receives density information from the density sensor 41 and executes various processing based on the input density information. Detailed processing to be performed by the density information processing unit 25 is described below with reference to FIG. 5B. An FG signal processing unit 26 receives the FG signal output from the motor 6 and performs various processing based on the input FG signal. Detailed processing to be performed by the FG signal processing unit 26 is described below with reference to FIG. 5C.

A test patch generation unit 35 performs control relating to processing for forming a detection pattern (hereinafter, referred to as "test patch") 39 on the intermediate transfer member 127. The test patch 39 is usable in density detection and is constituted by a toner image. In this respect, the test patch generation unit 35 can be referred to as a test patch forming unit. The density sensor 41 irradiates the formed test patch 39 with light and detects characteristics of reflection light. The density sensor 41 transmits a detection result to the control unit 21. In the present exemplary embodiment, an image itself of the test patch includes density unevenness, and the density unevenness is periodical in the sub scanning direction.

A correction information generation unit 36 generates density correction information based on a detection result of the test patch 39 detected by the density sensor 41. The density correction information is described below in more detail with reference to FIG. 14. An image processing unit 37 receives a signal input from the image input signal transmission unit 50 and performs image processing, such as halftone processing, on various images based on the input signal. An exposure control unit 38 controls the exposure unit 24 to perform exposure processing in synchronization with an FG count value, so that a test patch can be formed on the intermediate transfer member 127 through electrophotographic processes.

A motor control unit 40 controls operations to be performed by the motor 6. More specifically, the motor control unit 40 is capable of causing the motor 6 to start and stop an operation. Further, the motor control unit 40 calculates a difference between speed information obtained from the FG signal of the motor 6 and a predetermined target value to control the motor 6 to rotate at a predetermined speed. The motor control unit 40 multiplies the obtained difference value with a control gain and obtains a control amount. The motor 6 performs an operation based on the control amount supplied from the motor control unit 40.

Figure 5B:
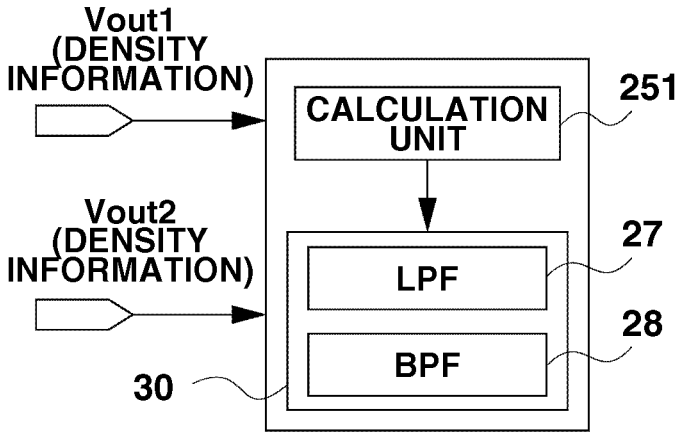
Figure 5C:
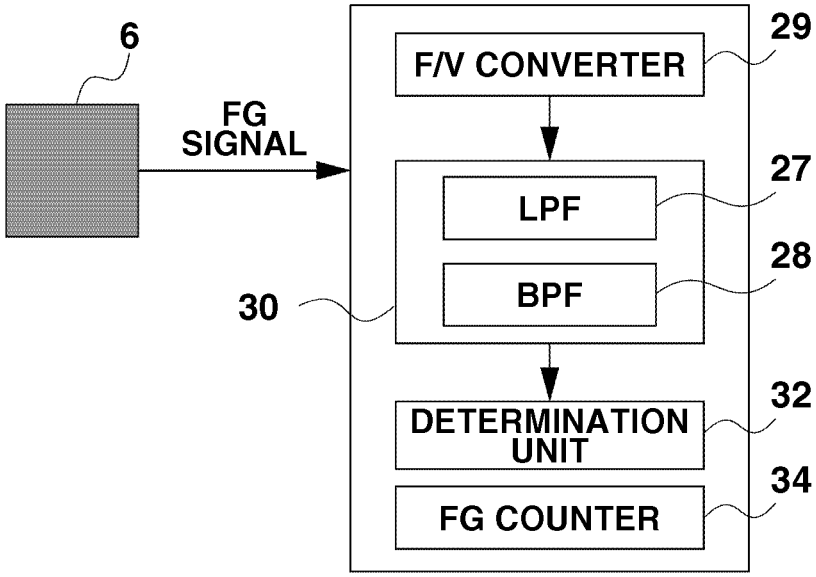

Next, contents illustrated in FIGS. 5B and 5C are described in detail. FIG. 5B illustrates details of the density information processing unit 25. The density information processing unit 25 includes a calculation unit 251 and a filter unit 30. The calculation unit 251 receives density information (i.e., Vout1 or Vout2) from the density sensor 41 and converts the input density information from a light quantity value to a density value. Further, if necessary, the calculation unit 251 inputs the converted density information to the filter unit 30. More specifically, the calculation unit 251 determines a correspondence between the sensor output G213 and the toner density illustrated in FIG. 2B beforehand and stores the obtained correspondence information in the EEPROM. The density conversion is performed based on the information stored in the EEPROM.

The filter unit 30 includes a low-pass filter 27 (LPF 27) and a band-pass filter 28 (BPF 28). The LPF 27 can selectively transmit a signal having a specific frequency component. A cutoff frequency of the LPF 27 is a frequency component of the period corresponding to one complete revolution of the motor 6 (hereinafter, referred to as "W1 component"). The LPF 27 mainly transmits signals having a frequency equal to or less than the period corresponding to one complete revolution of the motor 6.

The BPF 28 can extract information relating to a predetermined frequency component from the input information. In the present exemplary embodiment, the BPF 28 is configured to extract information whose frequency is four times the frequency corresponding to one complete revolution of the motor 6 (=¼ period: hereinafter, referred to as "W4 component"). As filter characteristics, the BPF 28 includes two cutoff frequencies being set about a central frequency equal to the frequency of the W4 component.

FIG. 5C illustrates details of the FG signal processing unit 26. A frequency/voltage (F/V) converter 29 performs frequency analysis on an acquired FG signal. More specifically, the F/V converter 29 measures a pulse period of the acquired FG signal, and generates an output voltage that represents a period of rotational unevenness occurring in the motor 6. The FG signal processing unit 26 includes a filter unit 30 that is functionally similar to the filter unit 30 in the density information processing unit 25, although its detailed description is not repeated.

A determination unit 32 acquires a signal output from the filter unit 30 by an amount corresponding to one complete revolution of the motor 6. Then, the determination unit 32 calculates an average value of the acquired signal. After completing the average value calculation, the determination unit 32 compares the value output from the filter unit 30 with the calculated average value and resets a counter if predetermined conditions are satisfied.

An FG counter 34 counts the FG signal. More specifically, the FG counter 34 counts up from 0 to 31 with respect to the FG signal generated during a period corresponding to one complete revolution of the motor 6. If the count value reaches 31, then the FG counter 34 resets the count value to 0 and restarts successively incrementing the count value. In this manner, the FG counter 34 repetitively performs the count-up operation for counting up from 0 to 31. In the present exemplary embodiment, the FG counter 34 is provided in each motor 6. For example, when the motors are independently used to drive the Y, M, C, and K photosensitive drums 122Y, 122M, 122C, and 122K, the FG counter 34 is provided in each of the Y, M, C, and K photosensitive drums 122Y to 122K.

The above described hardware configuration and the functional block illustrated in FIG. 4 and FIGS. 5A to 5C are mere examples and, therefore, the present invention is not limited to the above described embodiment. For example, a specific integrated circuit can be used to perform a part or the whole of the functional operations to be realized by the control unit 21 illustrated in FIG. 4 and FIGS. 5A to 5C. On the other hand, the control unit 21 can perform a part or the whole of the functional operations to be realized by the specific integrated circuit illustrated in FIG. 4 and FIGS. 5A to 5C.

[A Flowchart Illustrating Exposure Output Correction Table Generation Processing]

Figure 6:
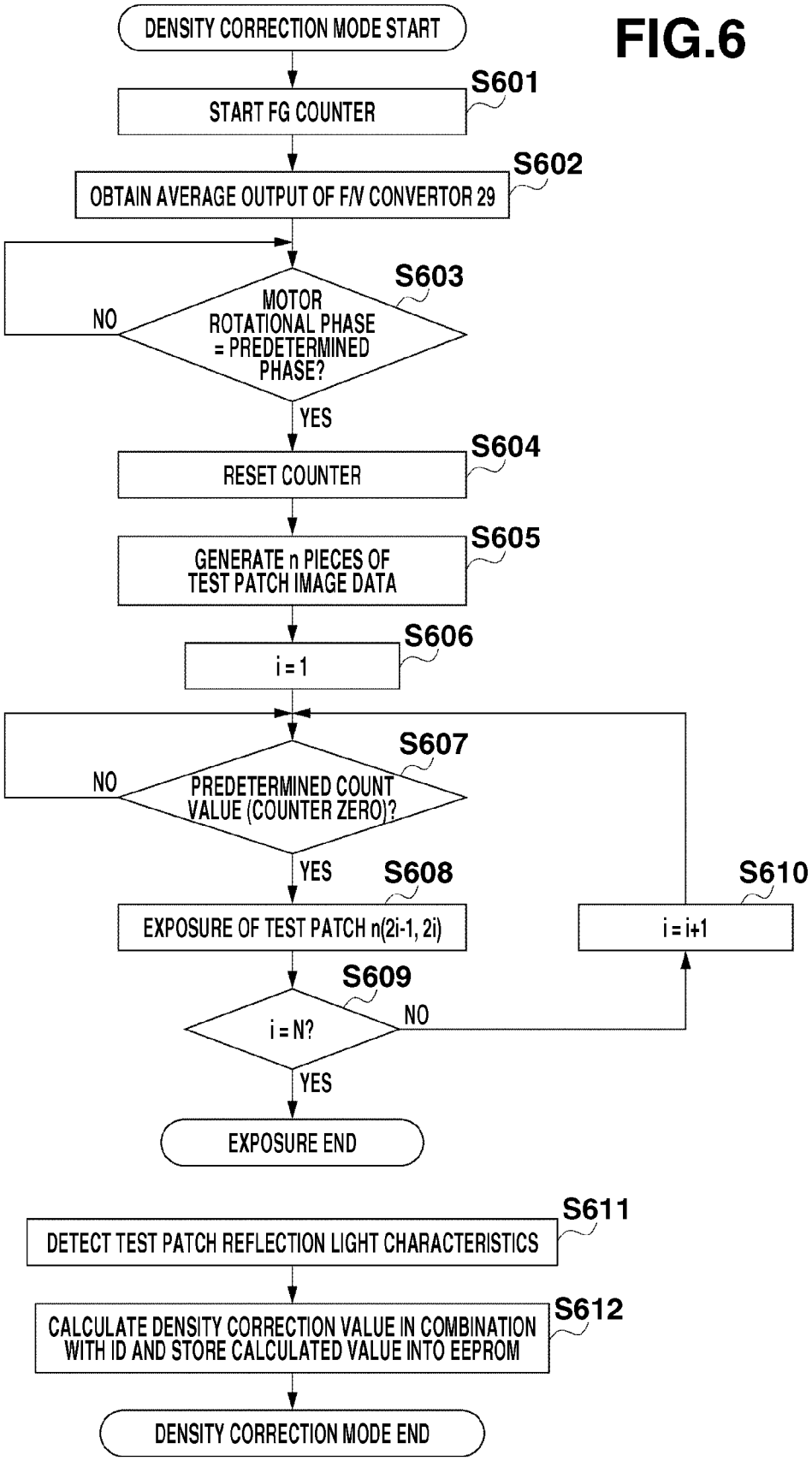
FIG. 6 is a flowchart illustrating exposure output correction table generation processing according to an exemplary embodiment of the present invention.

FIG. 6 is a flowchart illustrating exposure output correction table generation processing according to an exemplary embodiment of the present invention. By performing the processing of the flowchart illustrated in FIG. 6, the control unit 21 can define a relationship between phase information of motor rotational unevenness and phase information of density unevenness. Further, a correspondence table defining a relationship between motor phase information and the density correction information can be generated based on a correspondence between the phase information of the density unevenness and the density correction information.

The table generated in this manner can be used to reduce or eliminate the banding when printing is performed. The processing of the flowchart illustrated in FIG. 6 can be performed for each motor that drives one of the photosensitive drum photosensitive drums 122Y to 122K. Further, in a case where a plurality of photosensitive drums 122Y to 122K is driven by a single motor 6, the processing of the flowchart illustrated in FIG. 6 can be performed for the single motor. The processing to be realized according to the flowchart illustrated in FIG. 6 is described below in more detail.

First, in step S601, if the motor is in a predetermined frequency range after starting an operation in an exposure output adjustment mode, the FG counter 34 starts counting the FG signal of the motor.

Then, in step S602, the determination unit 32 extracts rotational unevenness occurring in the period corresponding to one complete revolution of the motor 6 (i.e. the W1 component), which is output from the F/V conversion unit 29 and further processed by the LPF 27. And, the determination unit 32 calculates an average value of the extracted rotational unevenness. In this case, the BPF 28 is usable if the setting of the BPF 28 is effective to extract the rotational unevenness occurring in the period corresponding to one complete revolution of the motor 6.

Next, in step S603, the determination unit 32 determines whether the phase of the rotational unevenness of the motor, which corresponds to the W1 component, is equal to a predetermined phase. In the present exemplary embodiment, for example, the determination unit 32 checks whether the phase of the rotational unevenness occurring in the motor 6 has become zero. For example, the determination unit 32 determines that the phase of the rotational unevenness has become zero momentarily when the FG signal value crosses a line representing an average output value of the LPF 27 in a transitional phase decreasing form a higher side to a lower side.

In this case, the determination phase to be checked in step S603 is not limited to zero. For example, the determination phase can be 90° if the determination phase is identical to that of a trigger that starts the exposure for a test patch in S607. If the determination unit 32 determines that the phase of the rotational unevenness of the motor is equal to a predetermined phase (YES in step S603), then in step S604, the determination unit 32 resets the FG counter 34.

The determination unit 32 can identify the phase of the motor 6 by counting the FG signal after resetting the FG counter. Further, the determination unit 32 can identify the rotational unevenness of the motor 6 as having a zero phase when the FG count value is zero (FGs). The determination unit 32 continuously monitors the count value of the FG signal until a print job is accomplished.

Figure 8:
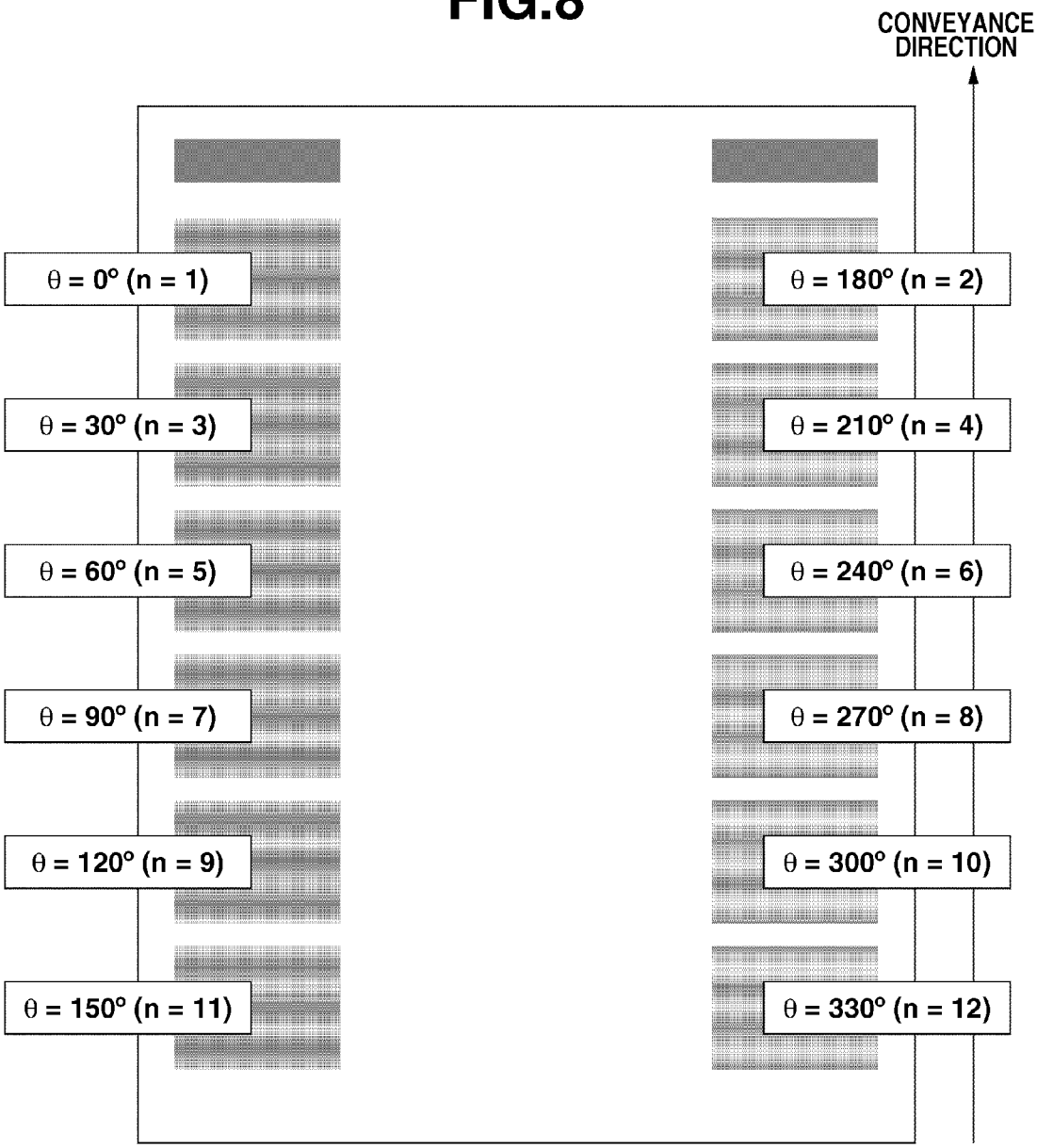
FIG. 8 illustrates an example of test patch formation.

In step S605, the test patch generation unit 35 generates (prepares) a total of n pieces of test patch data. Then, in step S606, the test patch generation unit 35 sets a parameter "i" to 1 (i.e., i=1). FIG. 8 illustrates an example of the test patch image data generated in step S605 that is formed on the intermediate transfer member 127. The test patch image data illustrated in FIG. 8 includes twelve test patches (six test patches in each row). All of the test patches include dark and light unevenness included in an image has a period similar to that of density unevenness induced by the motor 6. On the other hand, each test patch is different from each other in starting phase of the dark and light unevenness in an image, as described below in more details.

Referring back to the flowchart illustrated in FIG. 6, in step S607, the test patch generation unit 35 determines whether the count value of the FG signal of the motor 6 is equal to a predetermined value (e.g., "zero"). In other words, the test patch generation unit 35 determines the phase of the rotational unevenness occurring in the motor 6.

If it is determined that the count value of the FG signal of the motor 6 is equal to the predetermined value (YES in step S607), then in step S608, the test patch generation unit 35 causes the exposure unit 24 to expose the (2i-1)-th test patch and the 2i-th test patch. In this case, no exposure output correction table is used for the test patch forming operation.

Then, a toner image is developed based on a latent image formed on the photosensitive drums 122 through the exposure processing. Subsequently, the developed toner image is transferred onto the intermediate transfer member 127. While the intermediate transfer member 127 travels, the density sensor 41 scans each test patch in the sub scanning direction.

In step S609, the test patch generation unit 35 determines whether the exposure operation has been completed for all test patches. Namely, the test patch generation unit 35 determines whether the parameter "i" is equal to N (i.e., i=N?). If it is determined that the exposure operation has not been completed for all test patches (NO in step S609), then in step S610, the test patch generation unit 35 increments the parameter "i" by one (i.e., i=i+1). Then, in step S607, the test patch generation unit 35 performs the above described processing again.

Then, if the determination result in step S607 is YES, the test patch generation unit 35 causes the exposure unit 24 to expose the next test patch. Subsequently, the test patch generation unit 35 repeats the similar processing until the parameter "i" becomes equal to N (i.e., i=N). According to the example illustrated in FIG. 8, the test patch generation unit 35 repeats the similar processing until parameter "i" becomes equal to 6 (i.e., i=6). On the other hand, if it is determined that the exposure operation has been completed for all test patches (YES in step S609), the test patch generation unit 35 terminates the exposure processing.

In step S611, the density sensor 41 detects reflection light obtained from the test patch formed on the intermediate transfer member 127. The control unit 21 receives a detection result of the reflection light from the density sensor 41 via the density information processing unit 25.

In step S612, the correction information generation unit 36 calculates density correction information in association with the phase of the rotational unevenness occurring in the motor 6, based on the detection result obtained in step S611, to reduce the density unevenness induced by the rotational unevenness occurring in the motor 6. Further, the correction information generation unit 36 stores the calculated density correction information in the EEPROM.

The above described calculation is described below in more detail with reference to a flowchart illustrated in FIG. 12. After the processing of the above described steps is completed, the test patch generation unit 35 terminates the exposure output correction table generation processing. In the present exemplary embodiment, the W4 component, rotational unevenness occurring in the motor 6 is a high-frequency component that is not perceived severely. Therefore, the W4 component can be excluded from the correction object to be subjected to the processing of the flowchart illustrated in FIG. 6. However, if it is desirable to perform similar exposure correction for the W4 component, it is useful to perform similar processing for both the W4 component and the W1 component.

[Processing for Associating a Phase of Rotational Unevenness Occurring in a Motor and Density Variation in a Toner Image]

Figure 7A:
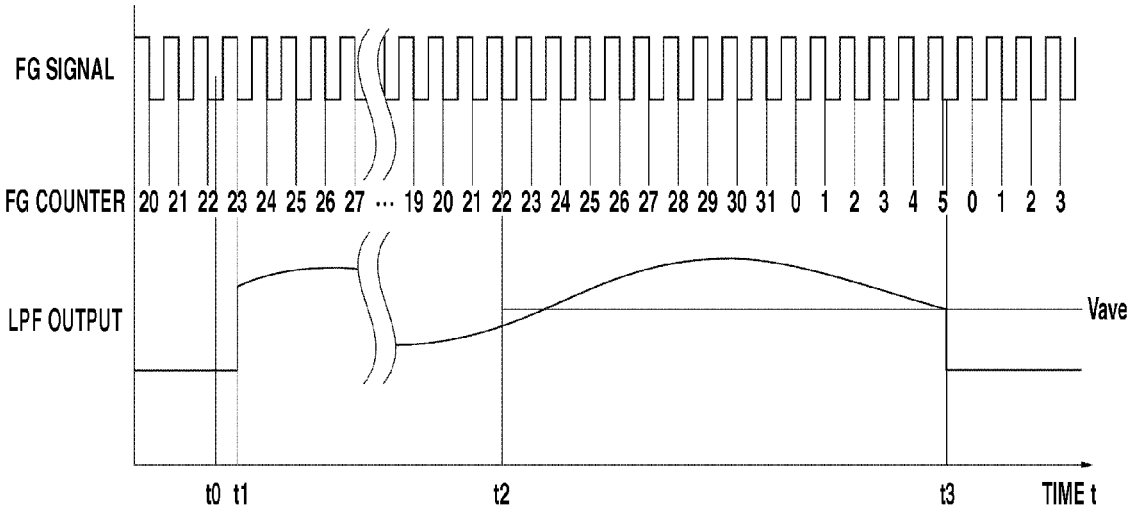
FIG. 7A is a timing chart illustrating motor FG count value reset processing.
Figure 7B:
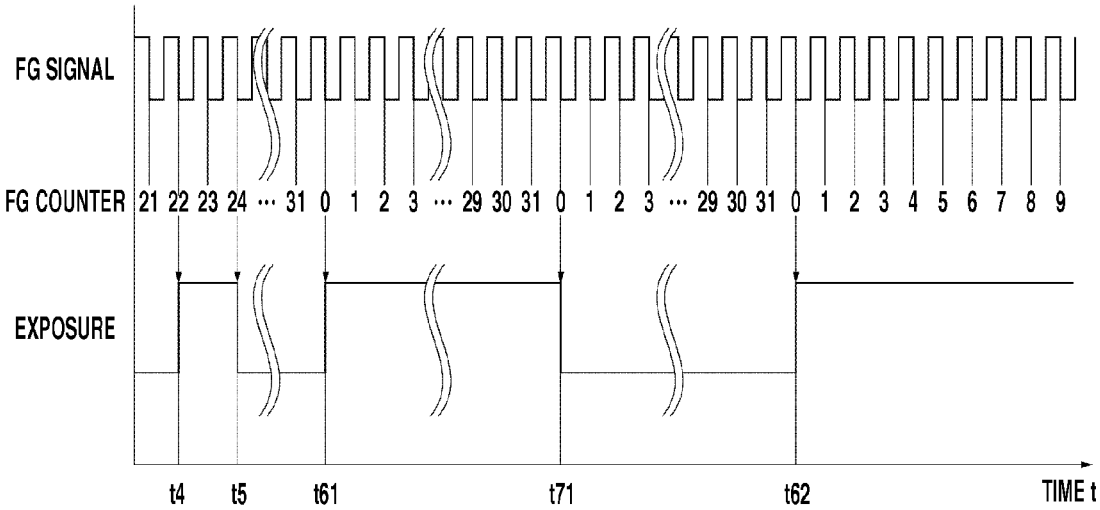
FIG. 7B is a timing chart illustrating a test patch exposure operation according to an exemplary embodiment of the present invention.

FIGS. 7A and 7B illustrate details of the processing to be performed in steps S602 to S610 illustrated in FIG. 6. FIG. 7A is a timing chart illustrating motor FG count value reset processing according to an exemplary embodiment of the present invention. FIG. 7B is a timing chart illustrating a test patch exposure operation according to an exemplary embodiment of the present invention. The timing charts illustrated in FIGS. 7A and 7B can be used to correlate a speed variation state of the motor 6 with a certain phase (e.g., phase zero (FG0)). According to the examples illustrated in FIGS. 7A and 7B, the phase zero (FG0) is allocated to the moment when the motor speed just crosses a line representing the average value in a transitional state where the motor speed decreases from a higher speed side to a lower speed side.

However, the present invention is not limited to the examples illustrated in FIGS. 7A and 7B. An arbitrary or predetermined speed variation state of the motor 6 can be correlated to any phase (e.g., phase zero (FG0)). In short, in a case where reproducibility is assured, an arbitrary or predetermined speed state of the motor 6 (i.e., the phase of the rotational unevenness of the motor 6) can be allocated to any phase (arbitrary or predetermined phase) of the motor 6 and, in other following processing, the phase allocated to the predetermined speed state can be identified based on the relationship allocated. Thus, the phase of the motor 6 can be designated, at other arbitrary timing, as a parameter usable for various processing. Example processing is described below in more detail.

First, in FIG. 7A, the control unit 21 performs initialization processing at timing t0. The determination unit 32 reads an output of the LPF 27 in synchronization with the FG signal initially input after the timing t0 (i.e., at timing t1).

In a period from t1 to t2 (FG signal corresponding to one complete revolution of the motor 6), the determination unit 32 calculates an average output value Vave of the LPF 27. The determination unit 32, after timing t2, compares the calculated average output value Vave with an input value received from the LPF 27. Then, at timing t3 when the predetermined condition is satisfied, for example, when the input value just shifts from a higher side to a lower side with respect to the average value Vave (YES in step S704), the determination unit 32 resets the FG counter to "0."

FIG. 7B is a timing chart illustrating an example of the test patch exposure operation, which corresponds to detailed processing to be performed in steps S605 to S610 illustrated in FIG. 6. In the present exemplary embodiment, it is assumed that the counting operation of the FG signal in the timing chart illustrated in FIG. 7B is continuous from timing chart illustrated FIG. 7A. In other words, it is assumed that the control unit 21 continuously identifies the phase of the rotational unevenness occurring in the motor 6 in accordance with a change in the FG count value.

First, characteristic features of the test patch according to the present exemplary embodiment are described below in more detail. The test patches according to the present exemplary embodiment are classified into two types. One type is a pre-patch to be used for generation of reading timing. The other type is an ordinary patch to be used for measurement of density unevenness.

The test patch generation unit 35 starts pre-patch forming (exposure) processing at timing t4 before the FG count value reaches a predetermined value at which ordinary patch exposure processing is started. In the present exemplary embodiment, the timing t4 is 10 FG counts earlier than the start timing of the ordinary patch expose processing. The pre-patch is a patch to be used to synchronize start timing for the density sensor 41 to detect the test patch. The pre-patch can be a short patch as long as the length of the pre-patch is sufficient for the density sensor 41 to detect. According to the example illustrated in FIG. 7B, exposure time for the pre-patch is equivalent to two FG counts and the exposure processing for the pre-patch stops at timing t5.

Then, at timing t61 when the FG count becomes zero, (YES in step S607), the test patch generation unit 35 starts the exposure processing for the ordinary patch (see step S608). The test patch generation unit 35 continuously performs the exposure processing until timing t71, so that the FG count value becomes equal to or greater than one complete revolution of the motor 6. As a result of the exposure performed during a period from t61 to t71, two test patches are formed on the intermediate transfer member 127, as illustrated in FIG. 8. More specifically, test patches corresponding to θ=0° and θ=180° are symmetrically disposed in the main scanning direction.

Further, at the next timing when the FG count becomes zero again (timing t62), the test patch generation unit 35 starts the second test patch exposure processing. In this manner, the exposure unit 24 repeats similar test patch exposure processing for a total of "n" test patches as described above with reference to the flowchart illustrated in FIG. 6. In this case, "n" is equal to "2i" in the flowchart illustrated in FIG. 6.

Then, through the electrophotographic processes described with reference to FIG. 1, a test patch for a toner image is finally formed on the intermediate transfer member 127. Regarding density unevenness appearing on each test patch, a test patch detection result includes influence of the rotational unevenness occurring in the motor 6 when the exposure processing is performed. Further, the test patch detection result includes influence of rotational unevenness occurring in the motor 6 when the transfer processing is performed. In this case, the source that generates the rotational unevenness in the exposure processing is identical to the source that generates the rotational unevenness in the transfer processing. A combination of the above described influences of two types of density unevenness can be detected from each test patch.

As described above, the exposure starts at timings t61 and t62, when the FG count value becomes zero. Further, the test patch at each moment is different in start phase of the dark and light unevenness itself in an image, as illustrated in FIG. 8. Namely, through the above described processing, a plurality of test patches can be formed. The formed test patches include images with the dark and light unevenness which are different in phase relative to the density unevenness induced by the rotational unevenness occurring in the motor 6.

Figure 9:
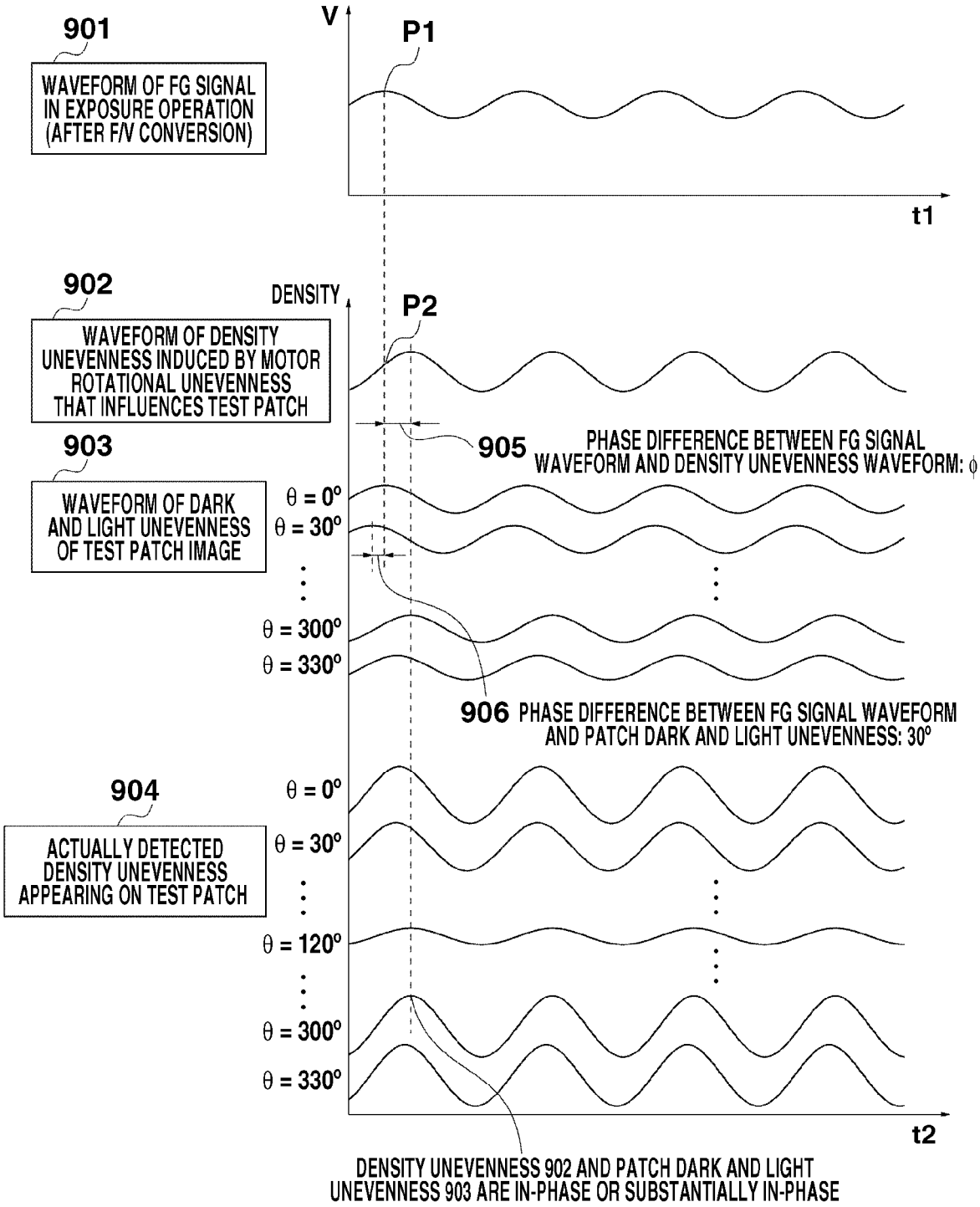
FIG. 9 illustrates an example of a relationship among a phase of rotational unevenness occurring in a motor, a phase of density unevenness generated on a patch, and a phase of dark and light unevenness included in a patch image.

FIG. 9 illustrates an example relationship among the phase of the rotational unevenness occurring in the motor 6 when the exposure is performed, the density unevenness phase generated on a patch due to the rotational unevenness occurring in the motor 6 when the transfer processing is performed, and the phase of dark and light unevenness included in a patch image.

More specifically, FIG. 9 illustrates an example phase 901 of the rotational unevenness occurring in the motor 6 and an example phase 902 of the density unevenness induced by the rotational unevenness occurring in the motor 6 and actually generated on a test patch. The density sensor 41 cannot actually detect the phase 902. FIG. 9 illustrates an example phase 903 of the dark and light unevenness included in the test patch image. The dark and light image included in each test patch has a different phase relative to the phase 901 of the rotational unevenness occurring in the motor 6, as illustrated in FIG. 9. Further, a phase difference (ϕ in FIG. 9) between the phase 901 of the rotational unevenness occurring in the motor 6 and the phase 902 of the density unevenness generated on the test patch is a fixed value in each motor.

Accordingly, the dark and light image included in each test patch has a phase different from the phase of the density unevenness. Then, a phase 904 of actually generated density unevenness is a combination of the phase 902 of the density unevenness generated on the test patch and the phase 903 of the dark and light unevenness included in the test patch image. The density sensor 41 can detect the phase 904 of the combined density unevenness.

In FIG. 9, when the relative phase difference is θ=300°, the density unevenness generated on each test patch is in phase or substantially in phase with the dark and light unevenness included in the test patch image. Therefore, the waveforms representing respective density unevenness are mutually emphasized. As a result, density unevenness (Dmax) having a largest amplitude among a total of twelve test patches can be generated.

In the present exemplary embodiment, the amplitude of the density unevenness represents the intensity of density variation. Any other parameter is usable if it can determine the magnitude of the density variation. In the following description, the amplitude of the density unevenness is used as a parameter that represents the intensity of the density variation.

[A Detail of a Density Value Read by a Density Sensor]

The reason why a test patch group illustrated in FIG. 8 is formed is because accuracy of a detection result (density unevenness phase, amplitude, etc.) decreases in a case where the diameter of a light detection area of the light receiving element is longer than one period of the density unevenness. Hereinafter, an example mechanism according to which the amplitude of the density variation becomes smaller and the phase of the density variation changes with respect to a detection value of the density detection sensor is described below with reference to FIGS. 10A to 10C in a case where the density unevenness generated in the sub scanning direction is read by the density sensor 41.

Figure 10A:
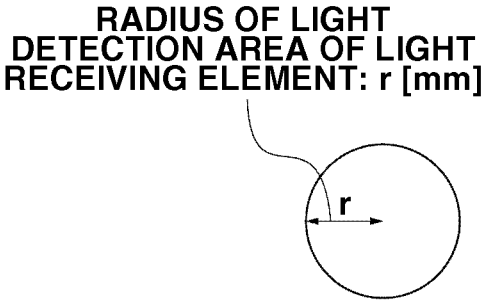
FIGS. 10A to 10C schematically illustrate an example of dark and light unevenness included in an image that can be detected by a density sensor.

First, as illustrated in FIG. 10A, it is assumed that the light receiving element of the density sensor 41 has a circular light detection area having a radius of "r" [mm]. Further, it is assumed that T [mm] represents a period of the dark and light unevenness to be read by the density sensor 41, D represents the density amplitude of the density unevenness, and "α" represents the phase of the dark and light unevenness at the central position of the light detection area of the light receiving element.

Figure 10B:
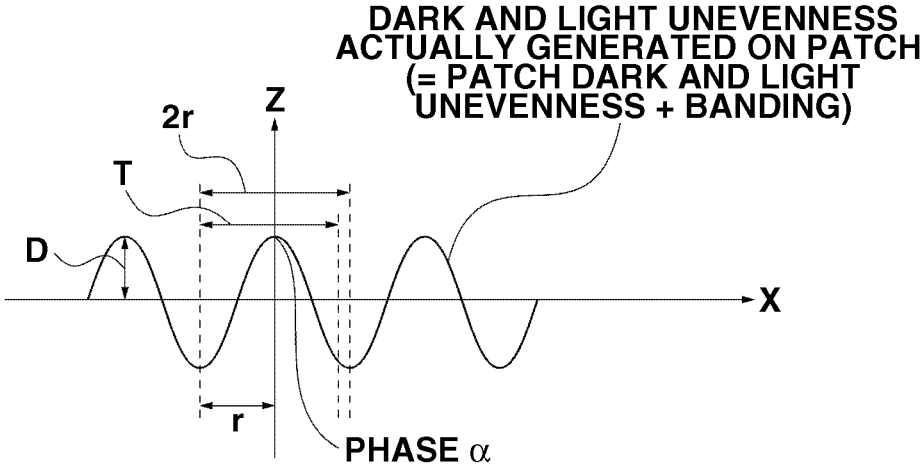
Figure 10C:
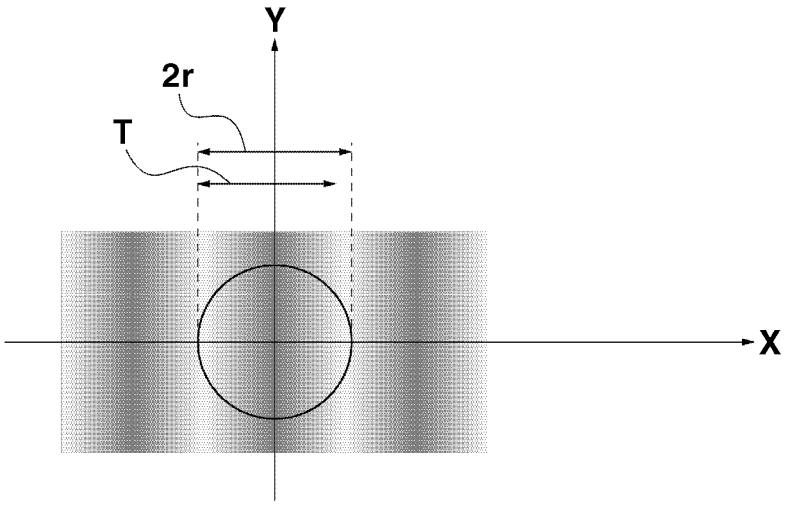

In FIGS. 10B and 10C, the X direction represents the sub scanning direction, the Y direction represents the main scanning direction, and the Z direction represents a density value of the dark and light unevenness (i.e., the intensity of reflection light from the patch). FIGS. 10B and 10C schematically illustrate measurement results with respect to the dark and light unevenness, which can be measured by the above described density sensor. FIG. 10B is a schematic illustration seen from the Y direction. FIG. 10C is a schematic illustration seen from the Z direction.

The following formula can be used to define a density z of the dark and light unevenness at a position offset by a distance x [mm] in the X direction from the central position of the light detection area of the light receiving element 41*b*, in which Dave represents an average density value of the dark and light unevenness. For example, the density information processing unit 25 can obtain the average density Dave by averaging the output of the calculation unit 251 or by averaging the output of the LPF 27.

$$z = D\sin\left(\alpha + \frac{2\pi}{T}x\right) + D_{ave} \quad \text{[Numerical Expression 1]}$$

Then, the following formula can be used to define an integral value in the X direction at a position offset by a distance y [mm] in the Y direction from the central position of the light detection area of the light receiving element (−r≤y≤r). In this case, it is assumed that an amount of light emitted from the light emitting element is uniform or substantially uniform in a light detection area of the light receiving element.

$$F_y = \int_{-\sqrt{r^2-y^2}}^{\sqrt{r^2-y^2}} z\,dx = \int_{-\sqrt{r^2-y^2}}^{\sqrt{r^2-y^2}} \left\{D\sin\left(\alpha + \frac{2\pi}{T}x\right) + D_{ave}\right\} dx. \quad \text{[Numerical Expression 2]}$$

A density F to be read by the density sensor 41 is equal to an integrated value of the above described formula (2), which is integrated in the Y direction by an amount corresponding to the length of the light detection area of the light receiving element. The following formula can be used to define the density F to be read by the density sensor 41.

$$F = \int_{-r}^{r} F_y\,dy \quad \text{[Numerical Expression 3]}$$

-continued $$= \int_{-r}^{r}\int_{-\sqrt{r^2-y^2}}^{\sqrt{r^2-y^2}} \left\{D\sin\left(\alpha + \frac{2\pi}{T}x\right) + D_{ave}\right\} dx\,dy$$

Figure 11A:
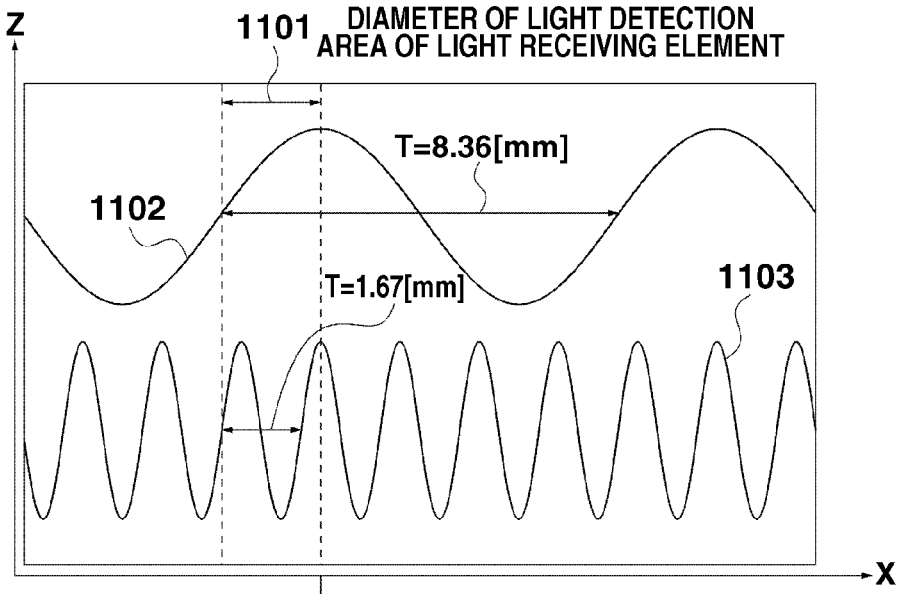
FIGS. 11A to 11C illustrate sensor outputs in relation with a period of density unevenness and a light detection area of a light receiving element that constitutes the density sensor.
Figure 11B:
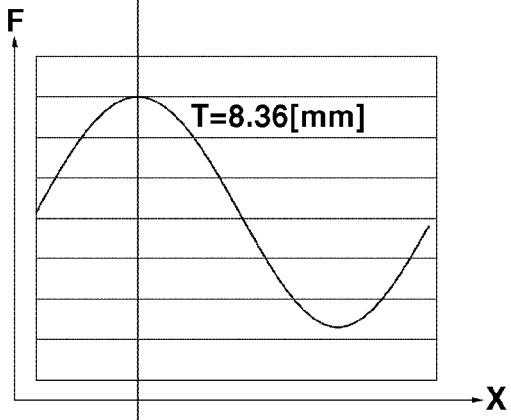
Figure 11C:
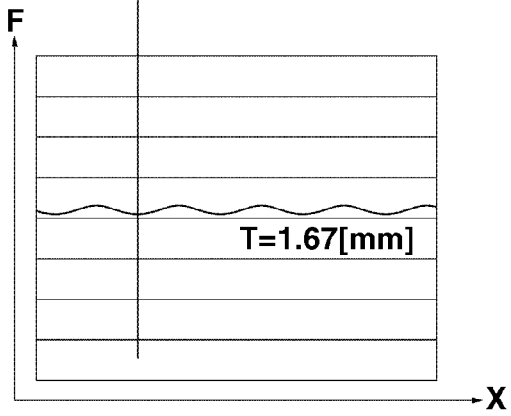

FIGS. 11A to 11C are graphs expressing the above described formula (3) in two cases of T=8.36 mm and T=1.67 mm. FIG. 11A illustrates a diameter 1101 of the light detection area of the light receiving element 41*b* and a waveform 1102 representing the density unevenness that occurs at a period T=8.36 mm. A waveform 1103 represents the density unevenness that occurs at a period T=1.67 mm. FIG. 11B illustrates a detection result of the waveform 1102 illustrated in FIG. 11A, which is the density unevenness occurring at the period T=8.36 mm. FIG. 11C illustrates a detection result of the waveform 1103 illustrated in FIG. 11A, which is the density unevenness occurring at the period T=1.67 mm.

As illustrated in FIG. 11B, when the period is 8.36 mm, it is understood that the detection result reflects an actual phase and an actual amplitude. On the other hand, when the period is 1.67 mm, namely, when the light detection area of the light receiving element 41*b* is sufficiently small compared to the period of the density unevenness, it is understood that the amplitude of the density variation becomes smaller and the phase of the density variation is inverted.

In this respect, the applicant of this application has confirmed actual values with respect to the amplitude and the phase difference relative to a density variation in two cases of 1.8 mm and 2.0 mm in period. As a result, it is confirmed that in the case where the period is 1.8 mm the phase is similar to that of the waveform 1103. However, in the case where the period is 1.8 mm, the amplitude is relatively small. On the other hand, it is confirmed that in the case where the period is 2.0 mm the amplitude is approximately ¼ of that of the waveform 1103. In the present exemplary embodiment, the light detection area (i.e., a hatched portion in the drawing) of the light receiving element 41*b* has a diameter of 2.09 mm. It can be understood that the detection method according to the present exemplary embodiment is effective in a case where the period of the density unevenness is substantially equal to or less than the diameter of the light detection area of the light receiving element 41*b*.

[Details of Reading Processing and Analysis Processing of a Test Patch]

Figure 12:
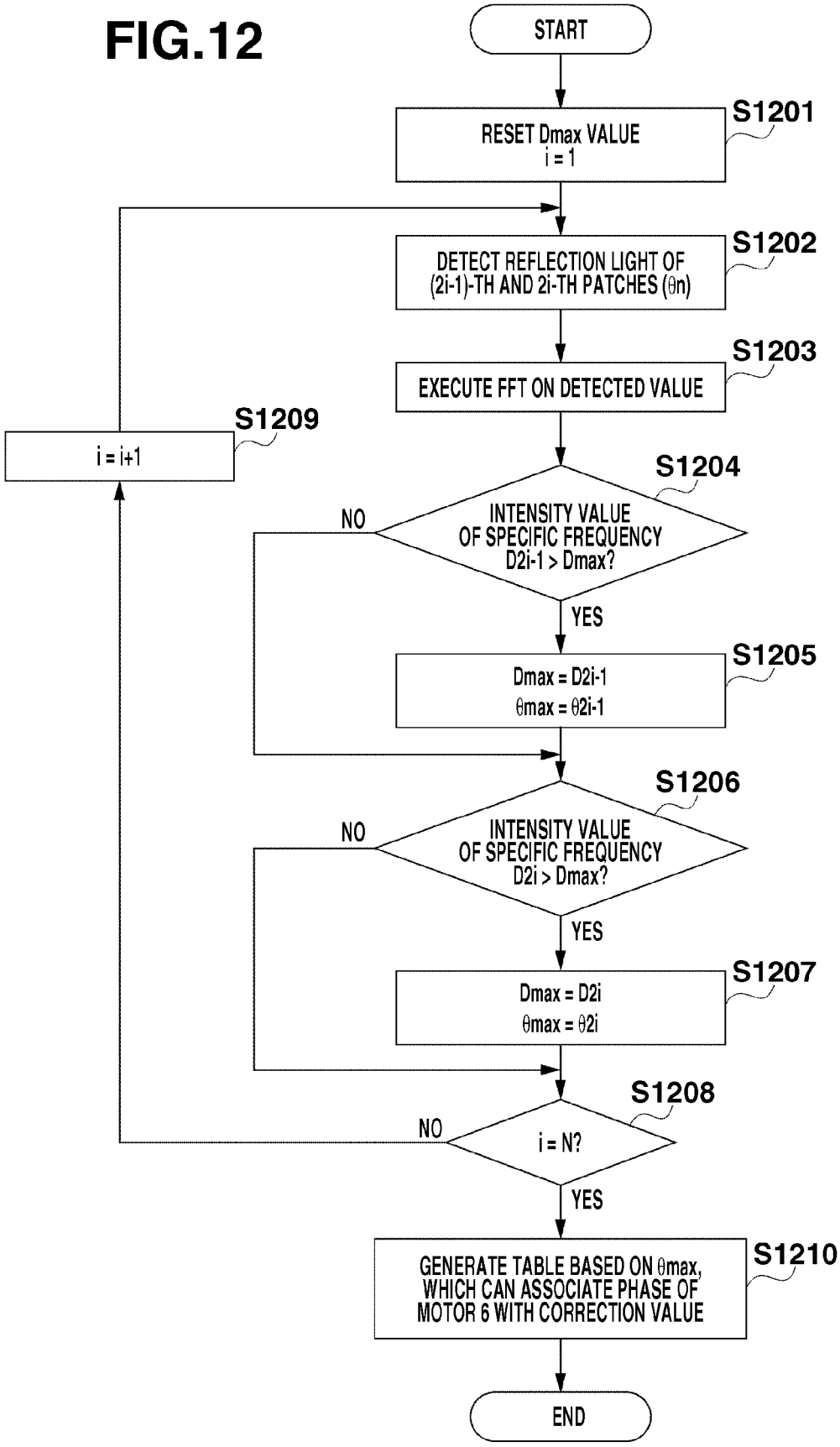
FIG. 12 is a flowchart illustrating test patch reading and analysis processing according to an exemplary embodiment of the present invention.

FIG. 12 is a flowchart illustrating detailed contents of the processing to be performed in steps S611 and S612 of the flowchart illustrated in FIG. 6. The correction information generation unit 36 executes the processing of respective steps illustrated in FIG. 12 to generate an exposure output correction table as described in detail below.

First, in step S1201, the correction information generation unit 36 resets the value of Dmax servings as predetermined amplitude and sets the parameter "i" to 1. In the present exemplary embodiment, Dmax is the largest density unevenness, with respect to the specific frequency (W1 component), among detection results of the test patches illustrated in FIG. 8.

Next, in step S1202, the density sensor 41 detects density information of the first test patch. Then, in step S1203, the correction information generation unit 36 performs Fast Fourier Transform (FFT) analysis on the detected density information. As a result, the correction information generation unit 36 can obtain intensity values of the density unevenness generated at various periods on the test patch. The method for analyzing the intensity of a specific frequency component is not limited to the FFT analysis. For example, it is useful to perform a setting for extracting a specific frequency relevant to the LPF 27 and the BPF 28 illustrated in FIG. 5 and to determine the intensity of the density variation based on outputs of the LPF 27 and the BPF 28.

Next, in step S1204, the correction information generation unit 36 determines whether an intensity value D2*i*-1 of the specific frequency obtained in the processing of step S1203 is greater than the present Dmax. If it is determined that the intensity value D2*i*-1 is greater than the present Dmax (YES in step S1204), then in step S1205, the correction information generation unit 36 updates both Dmax and θmax.

Further, in steps S1206 and S1207, the correction information generation unit 36 performs processing for D2*i* and θ2*i*, which is similar to the processing performed in steps S1204 and S1205. In the present exemplary embodiment, θ2*i*-1 and θ2*i* represent a phase difference between the phase of the rotational unevenness occurring in the motor 6 during the patch exposure operation and the phase of dark and light unevenness included in the test patch image.

The example illustrated in FIG. 9 is a case where the phase difference is equal to 30°. Further, the phase 901 and the phase 902 are in a fixed relationship which indirectly corresponds to a phase difference between the phase of the density unevenness induced by the rotational unevenness occurring at a predetermined period in the motor 6 and the phase of the dark and light image included in the test patch.

Then, in step S1208, the correction information generation unit 36 determines whether the above described detection and analysis processing has been thoroughly completed for all test patches. Namely, the correction information generation unit 36 checks whether the parameter "i" is equal to N (i.e., i=N). If detection and analysis processing has not been thoroughly completed for all test patches (NO in step S1208), the correction information generation unit 36 continuously performs the detection and analysis processing for the unprocessed test patches.

On the other hand, if the detection and analysis processing has been thoroughly completed for all test patches (YES in step S1208), then in step S1210, the correction information generation unit 36 generates a correction table in which the phase of the motor 6 is associated with a density unevenness correction value based on θmax. The correction table is described below in more detail with reference to FIG. 14. The θmax obtained in the flowchart illustrated in FIG. 12 corresponds to θ=300° illustrated in FIG. 9.

Figure 13A:
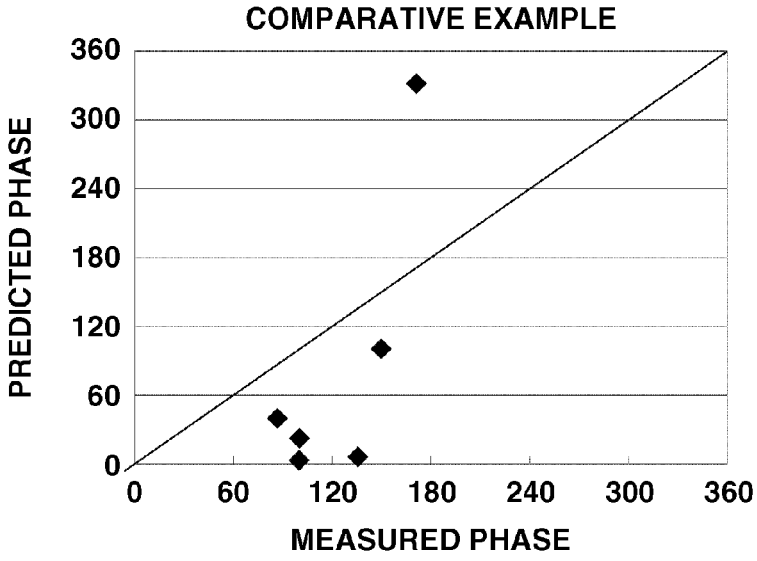
FIGS. 13A and 13B are graphs illustrating a phase difference between a phase of generated density unevenness and a phase of dark and light unevenness included in a test patch image, in comparison with a predicted phase difference.

An example of accuracy improvement in phase detection that can be realized by the processing of the flowchart illustrated in FIG. 12 is described below with reference to FIGS. 13A and 13B. FIG. 13A illustrates a comparable example, in which the abscissa axis indicates a phase difference between an actual phase of density unevenness induced by the rotational unevenness occurring in the motor 6 and a phase of image unevenness of a test patch. The phase difference illustrated in FIG. 13A is a measurement result actually obtained by a density sensor having higher resolution. Further, the ordinate axis indicates a calculated predicted phase difference. The comparable example illustrated in FIG. 13A does not use the detection method illustrated in FIG. 12 to obtain the phase difference indicated by the abscissa axis. Instead, the comparable example prints one test patch on the intermediate transfer member 127, detects the printed test patch with the density sensor 41 illustrated in FIG. 1, performs FFT analysis on a detection result, and calculates a phase of a specific frequency based on an obtained FFT analysis result.

Figure 13B:
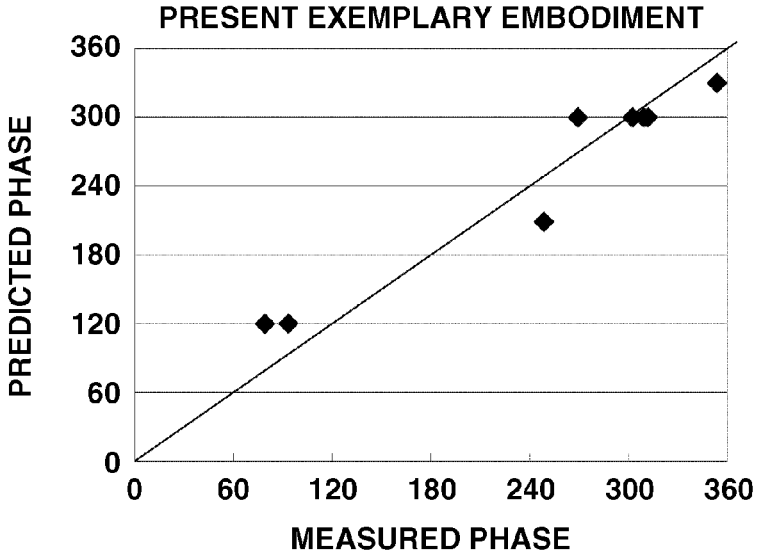

FIG. 13B illustrates a result according to the present exemplary embodiment, in which the abscissa axis is similar to that of FIG. 13A. On the other hand, the ordinate axis indicates a predicted phase difference obtained using the detection method illustrated in FIG. 12. The result illustrated in FIG. 13B has a better correlation coefficient at a lower left portion of the graph, compared to the result illustrated in FIG. 13A.

As described above, the method according to the flowchart illustrated in FIG. 12 can accurately estimate (calculate) the phase difference between the phase of density unevenness induced by the rotational unevenness occurring in the motor 6 and the phase of image unevenness of a test patch, compared to the comparable example.

[An Example of an Exposure Output Correction Table]

Figure 14:
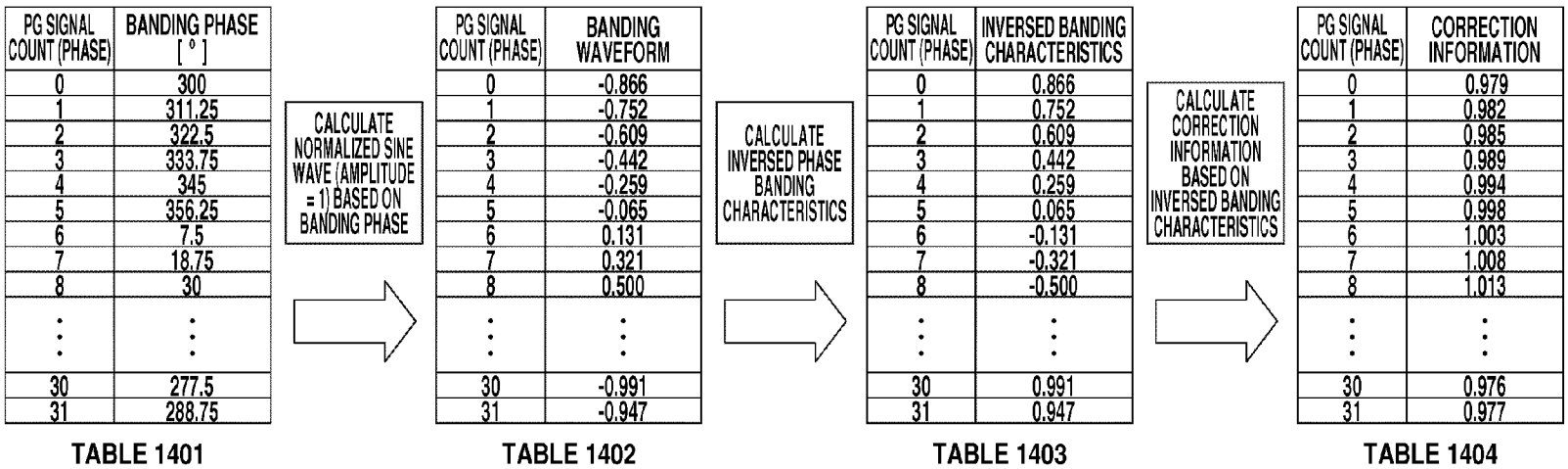
FIG. 14 illustrates an example of exposure output correction tables that can be used for banding correction according to a phase of rotational unevenness occurring in the motor.

FIG. 14 illustrates an example of the exposure output correction tables that can be generated by the correction information generation unit 36 according to θmax. The information illustrated in FIG. 14 is stored in the EEPROM. The control unit 21 can refer to the table information stored in the EEPROM when an image forming operation is performed. As a result, the control unit 21 can perform banding correction (i.e., density correction based on the exposure control) according to the phase of rotational unevenness occurring in the motor 6.

A table 1401 illustrated in FIG. 14 defines a relationship between the phase of rotational unevenness occurring in the motor 6 and the phase of dark and light unevenness of a test patch image itself. The table 1401 stores θmax obtained according to the flowchart illustrated in FIG. 12 in association with FG signal count 0 that corresponds to the phase zero of rotational unevenness occurring in the motor 6. FIG. 14 is a case where θmax is equal to 300°. Further, every time when an FG signal count value (FGs) is incremented by one, a value (θmax+FGsθ) is stored in a table A. In the present exemplary embodiment, a total of 32 FG pulse signals are output during one complete revolution of the motor 6. Therefore, the motor 6 rotates 11.25° as an angular displacement corresponding to one FG signal. In short, a relationship FGsθ=11.25°×FGs is satisfied.

Next, sine wave information of amplitude 1 is calculated based on the phase information stored in the table 1401 illustrated in FIG. 14, and a table 1402 corresponding to the FG signal count is generated. Further, a table 1403 is generated by inversing banding characteristics stored in the table 1402. Then, a table 1404 is generated by calculating density correction values from the inverse banding characteristics stored in the table 1403. More specifically, when Dave represents an average density of a test patch and Ar represents an amplitude for correction, a density correction value Dcn can be defined by Dcn=Dave/(Dave+Ar*inverse banding characteristics value).

In the present exemplary embodiment, the amplitude for correction Ar is a representative value determined beforehand based on data measured using a measuring device in a process of designing or manufacturing an image forming apparatus. In this respect, Ar is a fixed value and can suppress a predetermined level of density unevenness. Further, the average density of a test patch Dave is an average value of the detection result of each patch. An actually measured value or a predetermined value may be employed for Dave. In FIG. 14, Dave is set to 80 (i.e., Dave=80) and Ar is set to 2 (i.e., Ar=2) as example values. Then, for example, Dcn can be multiplied with a density value of a digital image.

FIG. 14 employs a table format that is usable for storage of information, although the present exemplary embodiment is not limited to the illustrated tables. Any other method can be employed to output density correction information. For example, it is useful to store, in the EEPROM, information relating to a calculation formula that is usable to output density correction information based on input phase information of the motor 6.

[Image Data Correction Processing 1]

Figure 15A:
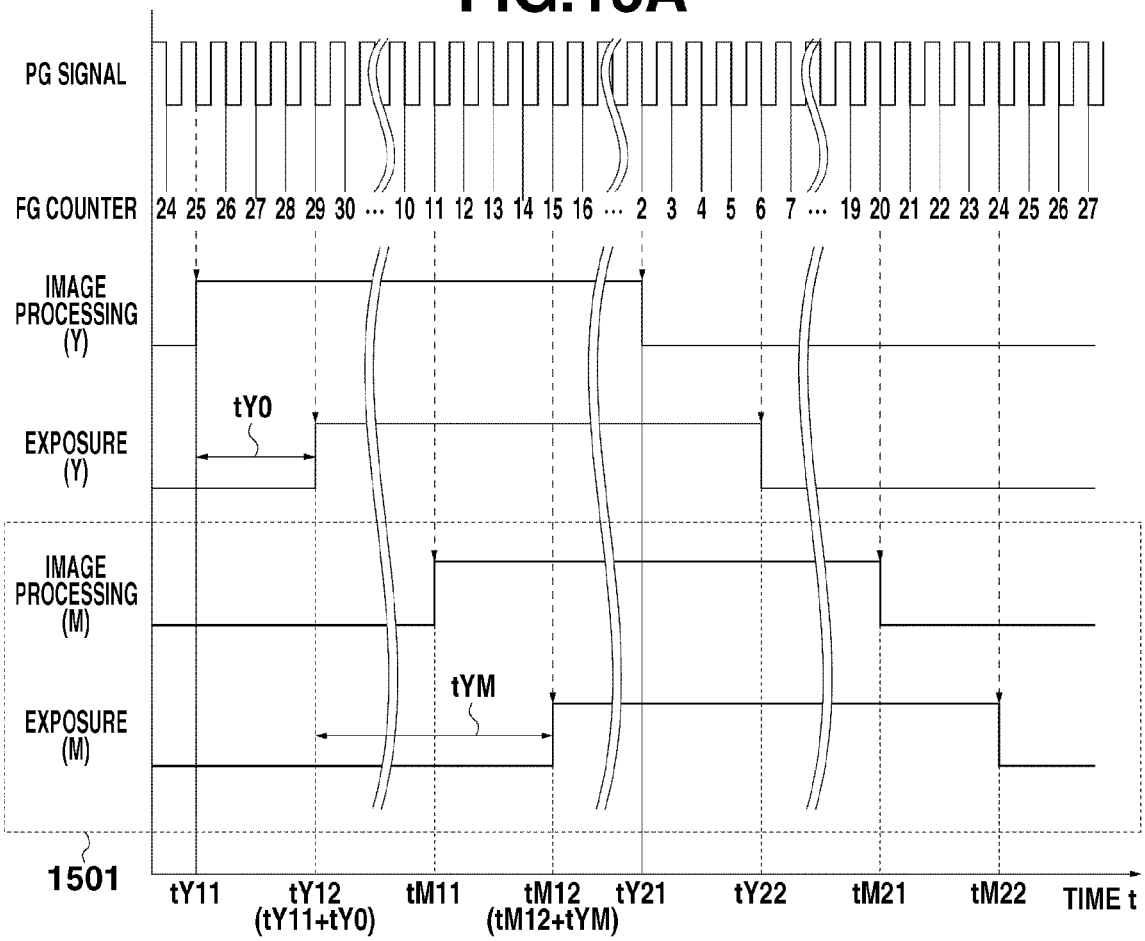
FIG. 15A is a timing chart illustrating a relationship between image data correction processing and exposure processing.

FIG. 15A is a timing chart illustrating example image data correction processing according to the phase of rotational unevenness occurring in the motor 6. The image data correction processing illustrated in FIG. 15A corresponds to one page data. According to the timing chart illustrated in FIG. 15A, banding correction for an image can be performed based on the phase of rotational unevenness occurring in the motor 6 using density correction information (e.g., correction tables illustrated in FIG. 14).

Figure 15B:
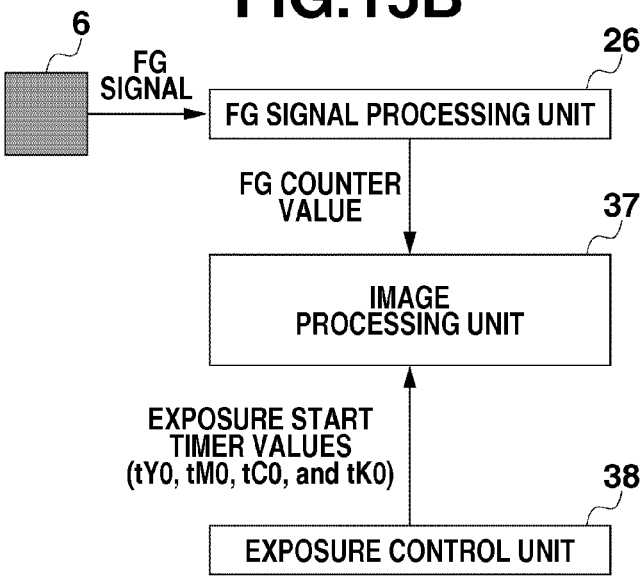
FIG. 15B is a functional block diagram according to an exemplary embodiment of the present invention.

FIG. 15B is a block diagram illustrating functional components that relate to the image data correction processing illustrated in FIG. 15A. Components similar to those illustrated in FIGS. 5A to 5C are denoted by the same reference numerals. Example operations to be performed by respective functional components illustrated in FIG. 15B are described below in detail.

First, at timing tY11, the exposure control unit 38 transmits, to the image processing unit 37, a notification that instructs starting exposure processing after elapse of tY0 seconds. In this case, the image processing unit 37 occasionally receives the FG count value from the FG signal processing unit 26. Therefore, based on the FG count value at the timing tY11 when the notification is received from the exposure control unit 38, the image processing unit 37 calculates an FG count value corresponding to tY0 seconds elapsed timing tY12 (=tY11+tY0). According to the timing chart illustrated in FIG. 15A, the FG count value corresponding to the notification received timing is 25 and a calculated FG count value corresponding to the exposure start timing is 29.

Then, based on the calculated FG count value corresponding to the exposure start timing, the image processing unit 37 reads density correction information from the exposure output correction table (see FIG. 14) and performs density correction (i.e., banding correction) on an image corresponding to one scanning line. The image processing unit 37 similarly performs the density correction independently for each of yellow and other color images.

Further, the following processing can be performed in a case where the motor 6 is commonly used to drive the yellow and magenta photosensitive drums 122Y and 122M. The exposure timings for yellow and magenta (other color) images are in a fixed relationship. Thus, it is useful to calculate the FG count value corresponding to the exposure start timing for the magenta (other color) image based on the FG count value at timing tY11 when the notification is received from the exposure control unit 38, as apparent from a rectangular portion indicated by a dotted line frame in FIG. 15A. In this case, the FG count value can be commonly used for the yellow and magenta images. In FIG. 15A, the exposure timing for the magenta image is delayed from the exposure timing for the yellow image by an amount equivalent to time tYM. Accordingly, the image processing unit 37 can identify the phase of rotational unevenness occurring in the motor 6 at the exposure start timing for the magenta image by adding an FG count value corresponding to time tYM to an FG count value corresponding to time tY12. Then, the image processing unit 37 can read density correction information corresponding to the identified phase of rotational unevenness from the exposure output correction table (see FIG. 14). Using the above described method, the image processing unit 37 can control the exposure unit 24 to perform exposure processing (tM12 to tM22) for the magenta image that is variable depending on the phase of the rotational unevenness occurring in the motor 6 (i.e., depending on the phase of density unevenness).

In the present exemplary embodiment, a total of 32 FG pulse signals are output during one complete revolution of the motor 6. Therefore, the motor 6 rotates 11.25° as an angular displacement corresponding to one FG signal. In other words, the image processing unit 37 sets a same value as the FG count value (i.e., phase) for a plurality of scanning lines which are scanned while the motor 6 rotates 11.25°.

Figure 16:
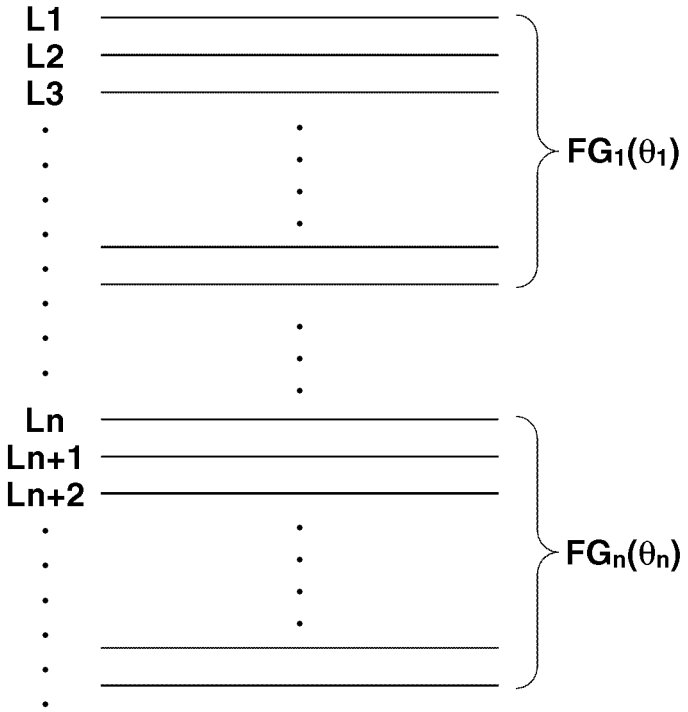
FIG. 16 illustrates an example relationship between a phase of rotational unevenness occurring in the motor and a plurality of scanning lines.

FIG. 16 illustrates an example of the relationship between the phase of the motor 6 and a plurality of scanning lines. More specifically, the same FG count value for the above described initial scanning line is allocated to a plurality of scanning lines that are in an area corresponding to the rotational angle 11.25° of the motor 6. Similarly, the next FG count value is allocated to a plurality of scanning lines that are in an area corresponding to the next rotational angle 11.25° of the motor 6. Allocation to the scanning lines is not limited to the unit of FG count value. Needless to say, it is useful to finely perform density unevenness correction by allocating a finely divided phase of the rotational unevenness occurring in the motor 6 to each scanning line based on the FG count value.

Then, the image processing unit 37 performs density correction for image data based on density correction information which is read from the exposure output correction table (see FIG. 14) corresponding to the FG count value (the phase of the rotational unevenness occurring in the motor 6) associated with each scanning line. Subsequently, by performing the density correction as described above, the image processing unit 37 can control the exposure unit 24 to perform exposure processing which is variable depending on the phase of the rotational unevenness occurring in the motor 6 (i.e., depending on the density unevenness), in a duration from time tY12 to time tY22. The image processing unit 37 can control the exposure unit 24 to perform similar exposure processing for yellow and other color images.

[Image Data Correction Processing 2]

Figure 17A:
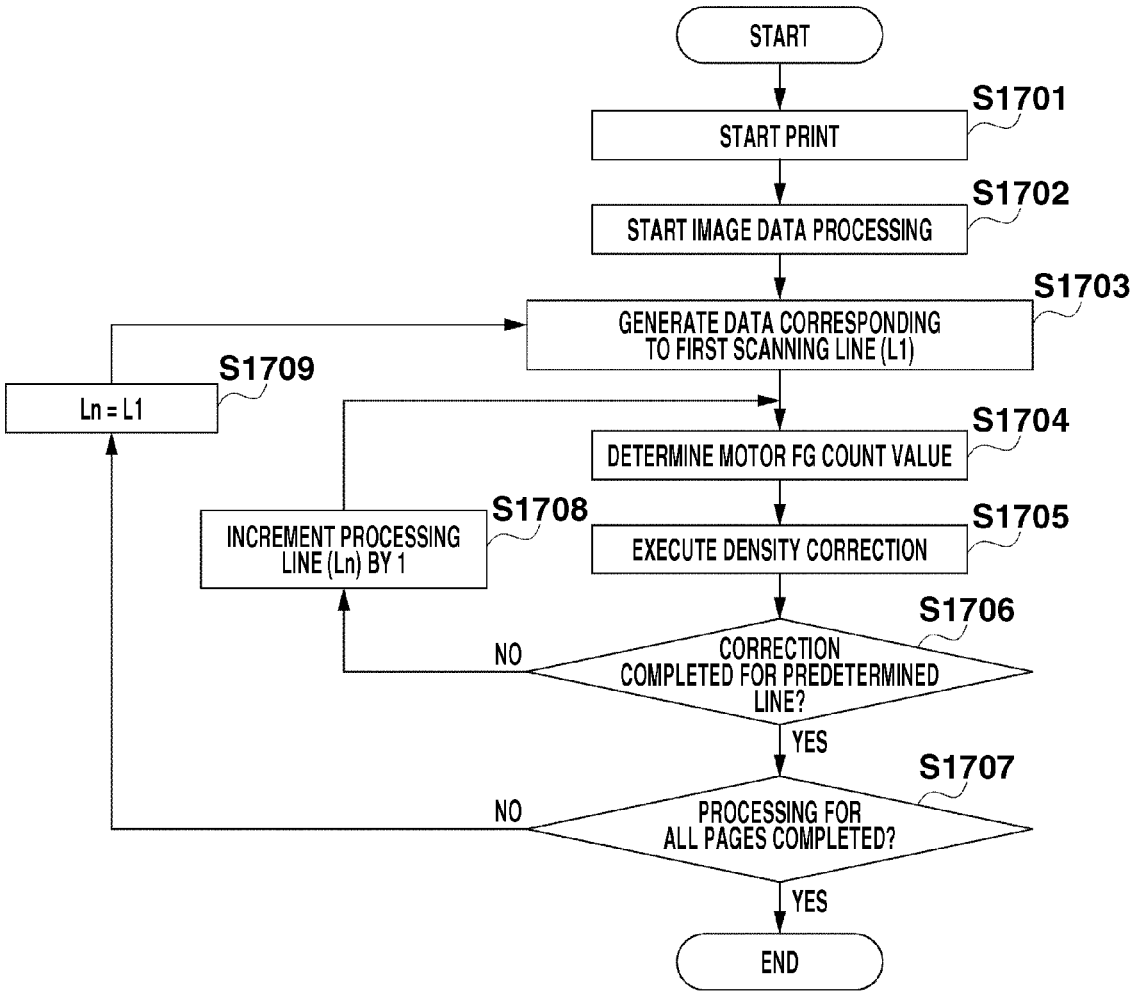
FIG. 17A is a flowchart illustrating image data correction processing.
Figure 17B:
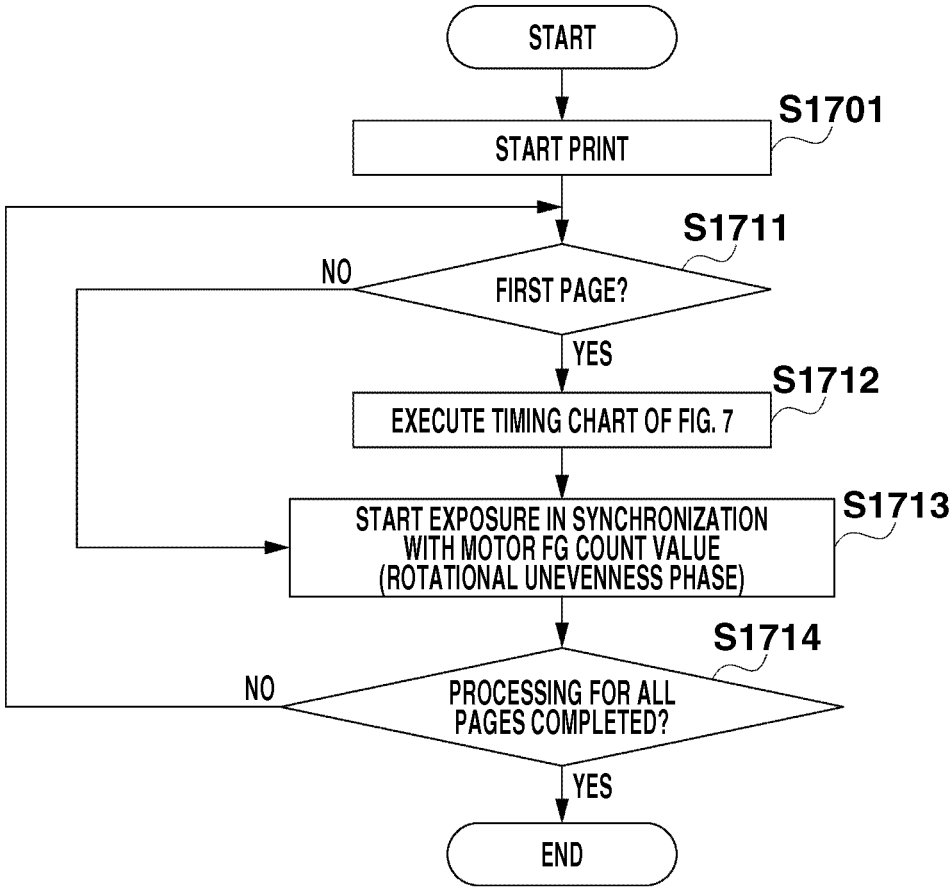
FIG. 17B is a flowchart illustrating exposure processing according to an exemplary embodiment of the present invention.

FIG. 17A is a flowchart illustrating an example of the image data correction processing that is variable depending on the phase of the rotational unevenness occurring in the motor 6. FIG. 17B is a flowchart illustrating an example of the exposure processing according to an exemplary embodiment. Executing the processing of the flowcharts illustrated in FIGS. 17A and 17B can realize the banding correction of an image based on density correction information (e.g., correction tables illustrated in FIG. 14) corresponding to the phase of the rotational unevenness occurring in the motor 6. Further, the processing illustrated in FIGS. 17A and 17B is useful in a case where one driving motor 6 is commonly used to drive all of the photosensitive drums 122Y to 122K and is applied to the exposure of the yellow image which is illustrated in a rectangle 1501 0*f* a dotted line in FIG. 15A in the image forming apparatus illustrated in FIG. 1.

First, the processing to be performed according to the flowchart illustrated in FIG. 17A is described below. In step S1701, the control unit 21 starts print processing. In step S1702, the image processing unit 37 starts processing image data for each scanning line. In the following processing, the image processing unit 37 repetitively performs exposure processing for exposing "n" scanning lines of one page, for each page included in a print job.

In step S1703, the image processing unit 37 reads an image in an area that corresponds to the first scanning line L1. Then, in step S1704, to determine a density correction value for density DL1 corresponding to the scanning lines L1, the image processing unit 37 identifies the phase (FG count value FGs) of the motor 6 that corresponds to the presently concerned scanning line. As described above, a total of 32 FG pulse signals are output during one complete revolution of the motor 6. Therefore, the motor 6 rotates 11.25° as an angular displacement corresponding to one FG signal. In other words, the image processing unit 37 sets a same value as the FG count value (i.e., phase) for a plurality of scanning lines which are scanned while the motor 6 rotates 11.25°.

In step S1705, the image processing unit 37 reads density correction information that corresponds to the determined FG count value FGs from the exposure output correction table (see FIG. 14) and performs density unevenness (banding) correction processing based on the read density correction information. Actually, every time when a determination result in step S1706 is NO, the image processing unit 37 allocates each phase of the rotational unevenness occurring in the motor 6 to an image of each line in the main scanning direction of the motor 6. Then, the image processing unit 37 performs image processing according to the phase (FGs) that is associated with each line image.

In step S1706, the control unit 21 determines whether the correction processing has been completed for a predetermined scanning line (e.g., the final scanning line on a page). If it is determined that the correction processing for the predetermined scanning line has not been completed (NO in step S1706), then in step S1708, the control unit 21 increments the processing line (Ln) by one. Then, the image processing unit 37 again executes the processing of steps S1704 and S1705 for the next scanning line.

On the other hand, if the processing for the predetermined scanning line has been already completed (YES in step S1706), then in step S1707, the control unit 21 determines whether the processing has been completed for all pages. If the control unit 21 determines that the processing has not been completed for all pages (NO in step S1707), then in step S1709, the control unit 21 sets the processing line Ln to the first scanning line L1. Subsequently, the control unit 21 executes the processing of step S1703 for the next page. Then, if the control unit 21 determines that the processing has been completed for all pages (YES in step S1707), the control unit 21 terminates the processing routine of the flowchart illustrated in FIG. 17A.

Next, the processing to be performed according to the flowchart illustrated in FIG. 17B is described below. The processing of the flowchart illustrated in FIG. 17B starts at the timing when the processing of step S1701 illustrated in FIG. 17A is performed.

First, in step S1711, the control unit 21 determines whether the page being currently processed is the first page of the print job. If it is determined that the currently processed page is the first page (YES in step S1711), then in step S1712, the control unit 21 executes the motor FG count value reset processing described above with reference to the timing chart of FIG. 7A.

Through the reset processing, the control unit 21 can associate the phase of the motor 6 with the speed variation state of the motor 6 at specific timing determined with reference to the timing chart of FIG. 7. Then, the control unit 21 identifies (monitors) a phase change of the motor 6 with a parameter of the FG count value. Thus, in the next step, the control unit 21 can control the scanner unit 24 to perform exposure processing for canceling the rotational unevenness occurring in the motor 6 in synchronization with the identified phase change of the rotational unevenness occurring in the motor 6.

Then, in step S1713, the control unit 21 identifies the phase change of the rotational unevenness occurring in the motor 6. If the phase of the rotational unevenness occurring in the motor 6 becomes the predetermined FG count value FGs, the control unit 21 controls the scanner unit 24 to synchronously start exposure processing and perform image formation processing. The predetermined FG count value FGs in the determination step S1713 is the phase of the motor 6 allocated to the first scanning line allocated in step S1704. Through the processing of step S1713, the scanner unit 24 performs exposure processing reflecting the density correction according to the phase of the rotational unevenness occurring in the motor 6.

The phase of the rotational unevenness occurring in the motor 6 gradually changes while sequential laser scanning is repetitively executed in step S1713. However, the density correction processing in steps S1703 to S1705 has been already completed according to a change of each phase (i.e., FG count value) of the rotational unevenness occurring in the motor 6. Therefore, the banding can be automatically reduced for each page.

In step S1714, the control unit 21 determines whether the processing has been completed for all pages. If it is determined that the processing has been completed for all pages (YES in step S1714), the control unit 21 terminates the processing routine of the flowchart illustrated in FIG. 17B. As described above with reference to FIGS. 15A and 15B through 17A and 17B, the present exemplary embodiment changes the content of the exposure processing according to the FG signal (i.e., motor phase information), thereby effectively reducing the density unevenness (banding) that may be induced by the rotational unevenness occurring in the motor 6. Further, if attention is paid to the rotational unevenness occurring in the motor 6, similar banding is not constantly generated at the same position of a recording sheet. However, even in such a case, the present exemplary embodiment can appropriately correct the density unevenness (banding).

Hereinafter, another example of the analysis processing according to a second exemplary embodiment of the present invention, which is different from the test patch analysis processing performed in steps S1201 to S1207 of the flowchart illustrated in FIG. 12, is described below with reference to FIG. 18. In the second exemplary embodiment, the control unit 21 performs processing similar to the flowchart illustrated in FIG. 6, except for the processing of step S612 (steps S1201 to S1207 illustrated in FIG. 12). Therefore, detailed descriptions for the similar steps are not repeated in the second exemplary embodiment.

In the first exemplary embodiment, the control unit 21 estimates a phase difference between the phase of generated density unevenness and the phase of image unevenness of a test patch based on the phase of dark and light unevenness of a test patch that has a largest dark and light unevenness value. However, the method for estimating a phase difference between the phase of density unevenness and the phase of dark and light unevenness of a test patch is not limited to the method employed in the first exemplary embodiment. For example, curve interpolation can be used to newly estimate the phase difference between the phase of generated density unevenness and the phase of a test patch image that includes dark and light unevenness.

Figure 18:
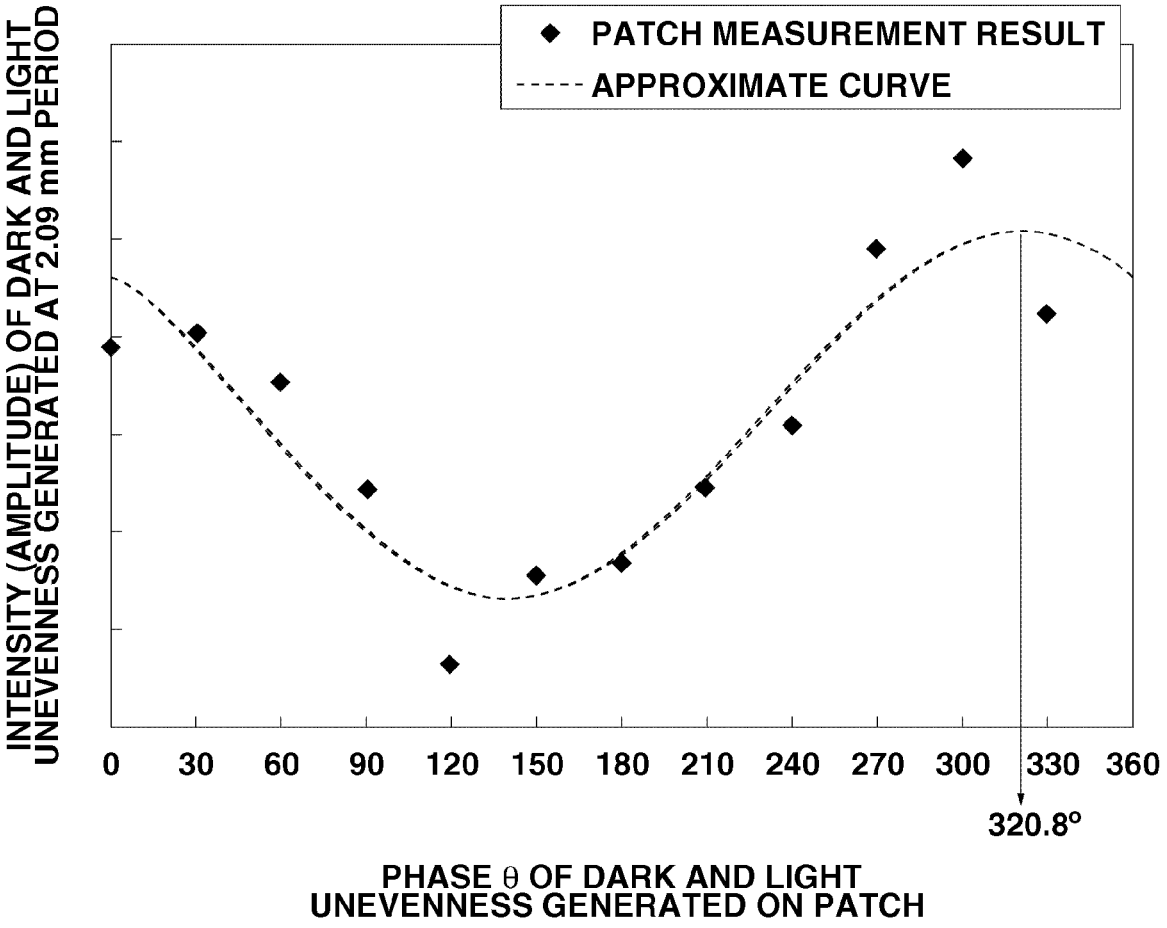
FIG. 18 illustrates test patch analysis processing according to an exemplary embodiment of the present invention.

FIG. 18 illustrates another example in which the phase of banding is identified according to the above described description. In FIG. 18, the abscissa axis indicates the phase of dark and light unevenness included in a test patch and the ordinate axis indicates the intensity of density unevenness generated on the test patch and measured by the density sensor 41. In FIG. 18, each plotted point represents a measurement result of the intensity of the waveform 904 corresponding to each phase illustrated in FIG. 9, which is measured by the density sensor 41. Further, a dotted line illustrated in FIG. 18 is a waveform which is obtained by interpolating the plotted points using a curve. From the example illustrated in FIG. 18, it is understood that 320.8° is a phase corresponding to a peak position of the dotted line waveform having been obtained through the curve interpolation based on the newly obtained phase.

A mechanism using the above described curve interpolation according to the second exemplary embodiment is useful to accurately calculate a phase difference between the phase of the generated density unevenness and the phase of the image unevenness of a test patch. The exposure output correction table illustrated in FIG. 14 can be generated based on θmax obtained by the mechanism illustrated in FIG. 18. As described above, the mechanism illustrated in FIG. 18 can be effectively used to accurately estimate the phase difference without depending on the resolution at the phase θ (i.e., the resolution at 30° in FIG. 8) of dark and light unevenness in the image included in a test patch.

Further, Dmax and θmax are automatically determined according to the flowchart illustrated in FIG. 12. However, the method for determining Dmax and θmax is not limited to the flowchart illustrated in FIG. 12. For example, it is useful to let a user select a test patch that includes a darkest density portion from a plurality of test patches that are detected in step S611 of FIG. 6 and transferred onto a transfer member while the control unit 21 executes the processing of the flowchart illustrated in FIG. 6.

In this case, the control unit 21 has already stored start phase information with respect to the dark and light unevenness in association with an identifier of each test patch. Therefore, the control unit 21 can identify θmax which corresponds to a case where the amplitude is maximized according to the identifier of a test patch if it is input by the user. Then, the control unit 21 can perform the processing of step S1207 illustrated in FIG. 12 according to the identified θmax.

Further, according to the flowchart illustrated in FIG. 12, the phase of the banding is determined by identifying a test patch whose dark and light unevenness is largest in amplitude. However, the method for determining the phase of the banding is not limited to the flowchart illustrated in FIG. 12. For example, it is useful to identify a test patch whose dark and light unevenness is smallest in amplitude. In this case, it is useful to define θmin that indicates the phase of dark and light unevenness that is included in the test patch whose dark and light unevenness is smallest in amplitude. The correction information generation unit 36 can identify θmax based on a relationship θmax=θmin+180°.

Further, it is useful to define θmid that indicates the phase of a test patch whose amplitude is intermediate between the minimum amplitude and the maximum amplitude. The correction information generation unit 36 can identify θmax based on a predetermined relationship between θmid and θmax. For example, it is useful to define a relationship θmax=θmid+90° beforehand in a case where the intermediate amplitude is in an increasing phase. It is also useful to define a relationship θmax=θmid+270° beforehand in a case where the intermediate amplitude is in a decreasing phase.

As described above, the predetermined amplitude to be targeted in the present exemplary embodiment can be arbitrarily selected from various amplitudes of the test patches illustrated in FIG. 8. Further, it is useful to adjust the FG count value by an amount equivalent to the advance (or retard) of the phase of density unevenness of an arbitrary test patch relative to the phase of density unevenness of the Dmax test patch. A table comparative to the above described table 1401 can be generated considering a correspondence between the adjusted FG count value and θ (i.e., θ illustrated in FIG. 8) allocated to the arbitrary target test patch.

In each of the above described exemplary embodiments, the formation of the test patches illustrated in FIG. 8 is described based on a phase including a target frequency component of the motor 6. A third exemplary embodiment is different from the above described exemplary embodiments in a standard to be referred to for forming test patches.

Figure 19A:
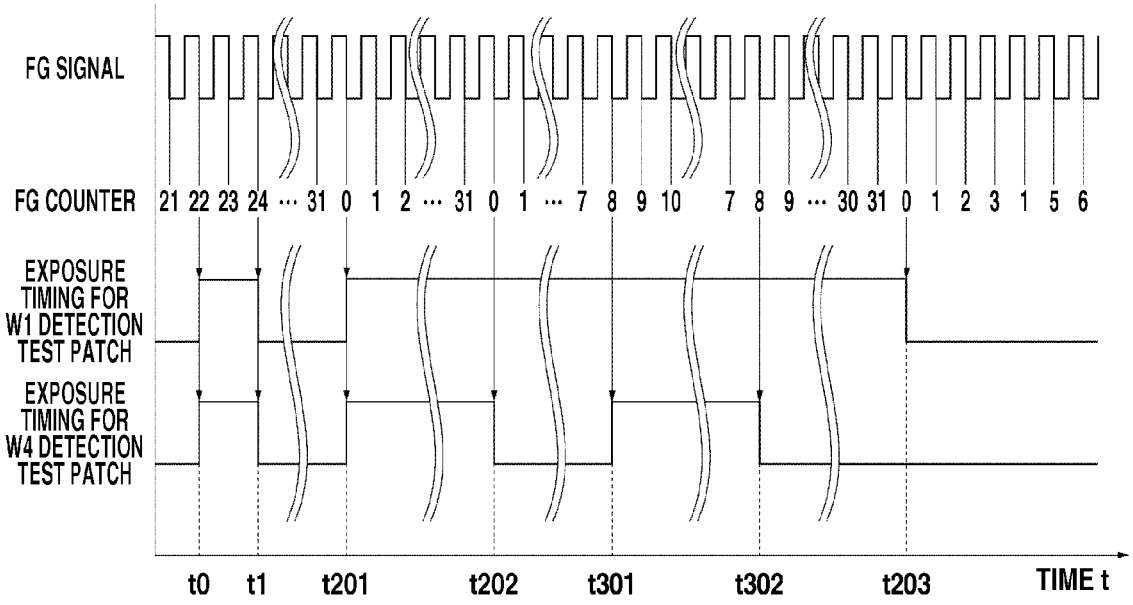
FIGS. 19A and 19B are timing charts illustrating an example of test patch formation according to an exemplary embodiment of the present invention.
Figure 19B:
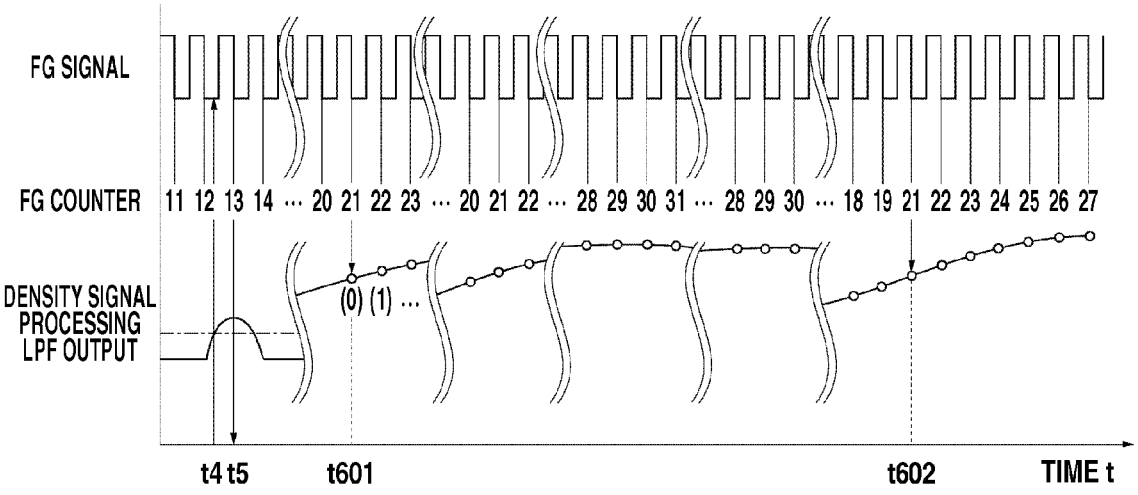

Correspondence between a rotational state of a motor and density unevenness that may be generated is in a predetermined or fixed relationship. Further, as described with reference to FIG. 3, motor rotational unevenness having the W1 component and motor rotational unevenness having the W4 component are in a predetermined relationship. Accordingly, to respond to the motor rotational unevenness having the W4 component, the phase of the motor rotational unevenness having the W1 component can be used as a parameter to form a test patch that includes dark and light images in different phases. FIGS. 19A and 19B are timing charts illustrating the above described features.

First, after stopping a pre-patch exposure operation, at timing t201 when the W1 component motor FG count value reaches a predetermined count value FGs (i.e., FGs=0 in FIG. 19), a test patch to be used to detect the motor rotational unevenness having the W1 component and a test patch to be used to detect the motor rotational unevenness having the W4 component are simultaneously exposed.

Next, the W1 component motor FG count value is added to at least one period of the W4 component detection test patch. More specifically, at timing t202 when the W1 component motor FG count value reaches FGs+8k (k is any one of 0, 1, 2, and 3), the exposure for the first test patch is stopped. Then, the exposure for the second test patch to be used to detect density unevenness of the W4 component starts at timing t301 when the W1 component motor FG count value reaches FGs+8k. The above described processing is repetitively performed until all test patches are formed.

Figure 20:
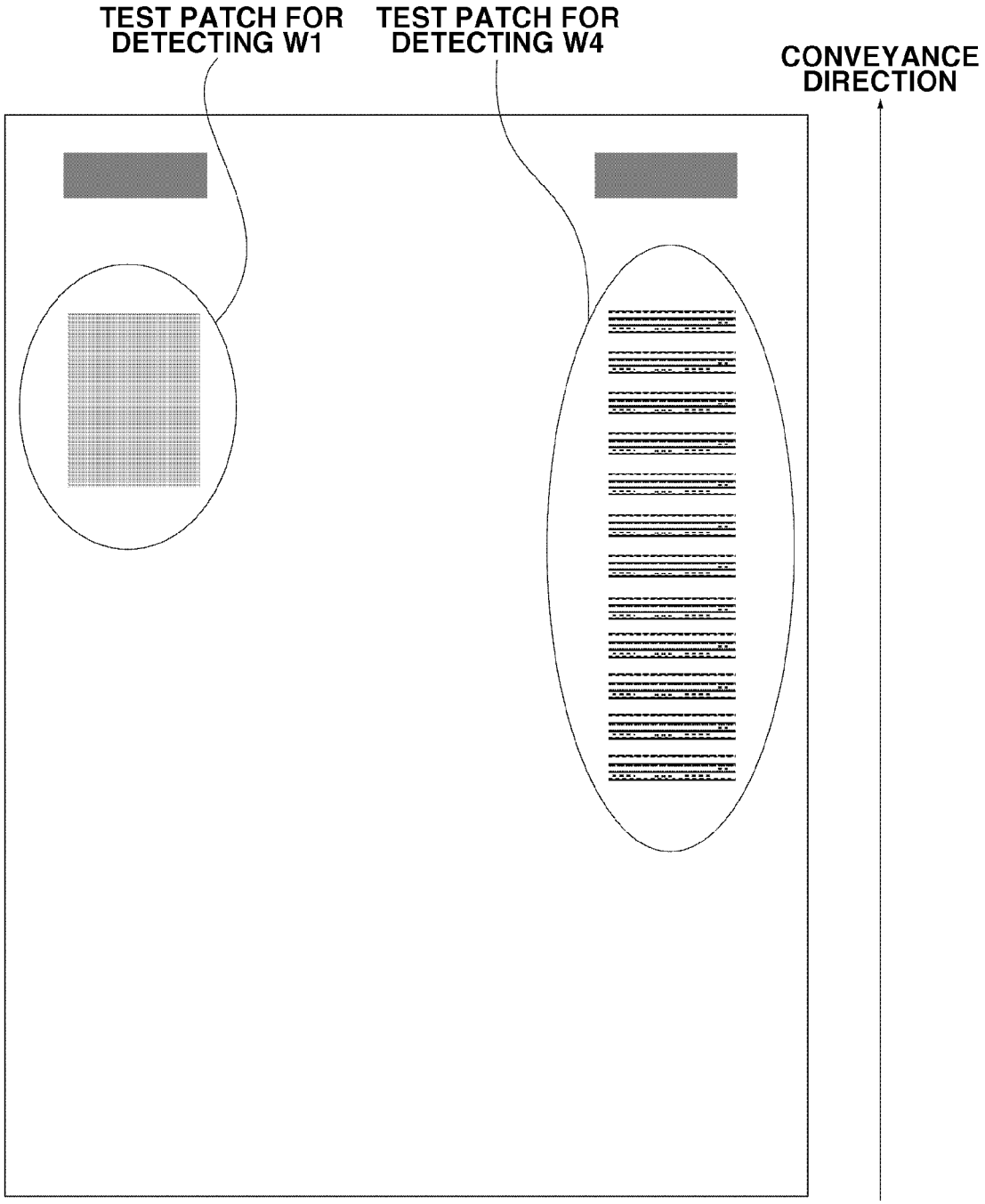
FIG. 20 illustrates an example of test patch formation.
Figure 22A:
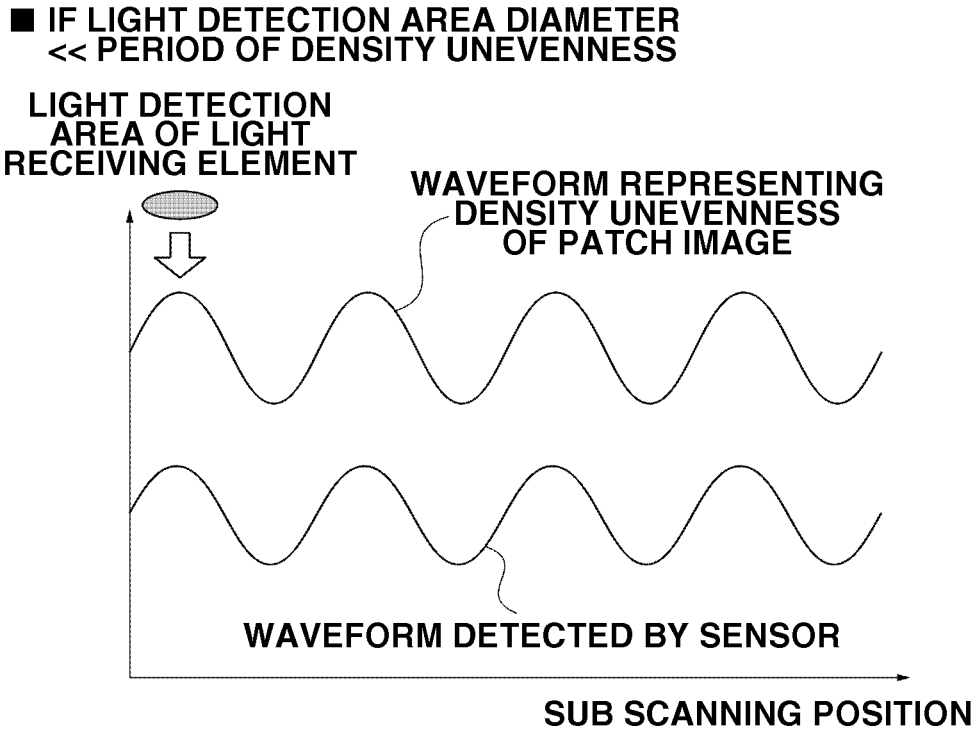
FIGS. 22A and 22B schematically illustrates a relationship between a diameter of a light detection area of a light receiving element that constitutes a density sensor and a density detection result.
Figure 22B:
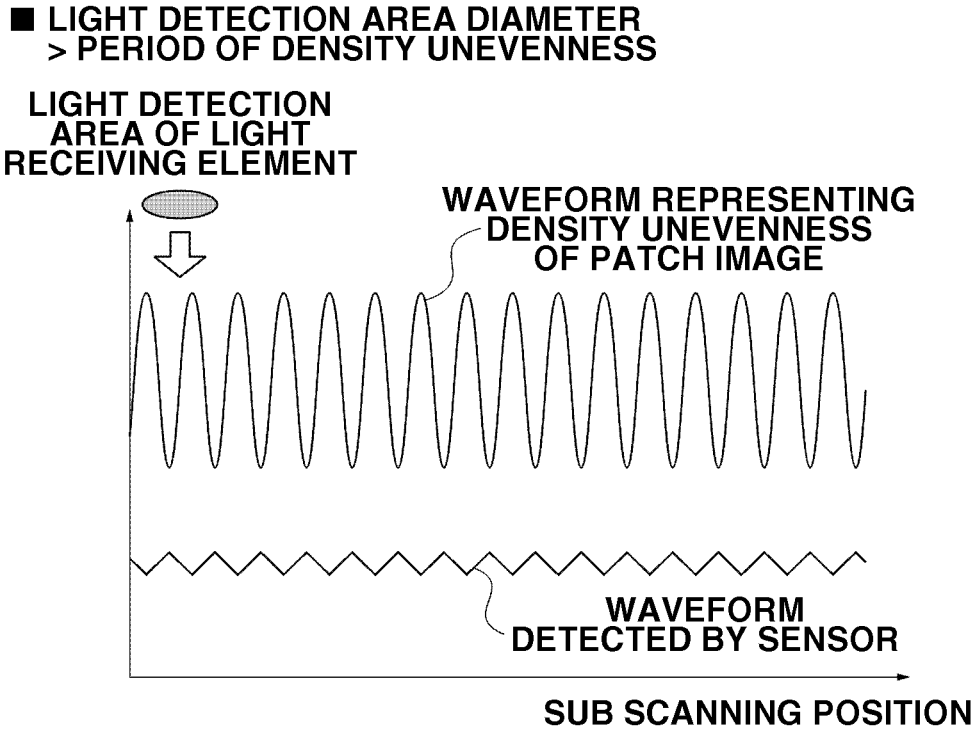

FIG. 20 illustrates an example of test patch image data that can be formed according to the present exemplary embodiment. As illustrated in FIG. 20, a test patch to be used to detect density unevenness of the W1 component is positioned on the left side and a test patch to be used to detect density unevenness of the W4 component is positioned on the right side, with respect to the conveyance direction of a sheet.

In the present exemplary embodiment, regarding the rotational unevenness of the W1 component, the light receiving element of the density sensor 41 has a light detection area whose diameter is sufficiently shorter than the length of one period of the density unevenness. Accordingly, the relationship between the motor rotational unevenness phase (FG signal) and the density unevenness can be identified without performing the processing of the flowchart illustrated in FIG. 6. On the other hand, the formation of the test patch to be used to detect the rotational unevenness of the W4 component is similar to that described in the first exemplary embodiment.

Regarding the rotational unevenness of the W4 component, after the formation of the test patches illustrated in FIG. 20 is completed, processing similar to that in each of the above described exemplary embodiments is performed. As a result, the above described density correction information for the W4 component is generated by the correction information generation unit 36.

In the third exemplary embodiment, the correction information generation unit 36 also calculates density correction information for the W1 component and respectively generates exposure output correction tables dedicated to the W1 component and the W4 component. FIGS. 21A to 21C illustrate examples of the exposure output correction tables generated in this manner.

[An Example of an Exposure Output Correction Table]

The information illustrated in FIGS. 21A to 21C is stored in the EEPROM. The control unit 21 can refer to the table information when an image forming operation is performed to perform banding correction (density correction realized by the exposure control) according to the phase of rotational unevenness occurring in the motor 6.

First, the correction information generation unit 36 generates a table 2101 illustrated in FIG. 21A. The table 2101 illustrated in FIG. 21A indicates a relationship between the W1 component motor FG count value (motor rotational unevenness phase) and the density value. The density value described in the table 2101 is based on a voltage value that is output via the LPF 27.

Next, the correction information generation unit 36 calculates a difference between each density value and an average value for the W1 component. Then, the correction information generation unit 36 generates a table 2102 that associates the calculated difference with corresponding phase information.

A table 2103 illustrated in FIG. 21B indicates a relationship between the W1 component motor FG count value (motor rotational unevenness phase) and a W4 component banding phase (the phase of dark and light unevenness included in a test patch image itself). The table 2103 stores θmax obtained according to the flowchart illustrated in FIG. 12 in association with the predetermined FG signal count value (8k (k=0, 1, 2 . . . )). FIG. 21B illustrates an example case where θmax is equal to 90°. Every time when the FG signal count value is incremented, the FG signal count value is associated with a predetermined banding phase and stored in the table 2103.

Next, the correction information generation unit 36 calculates a sine wave whose amplitude is equal to 1 based on the phase information stored in the table 2103 illustrated in FIG. 21B, and generates a table 2104 that associates the calculated sine wave with the FG signal count. Further, the correction information generation unit 36 calculates a W4 component banding value by multiply a banding amplitude value defined in the table 2104, and generates a table 2105.

Then, the correction information generation unit 36 adds W1 component banding characteristics stored in the table 2102 and W4 component banding characteristics stored in the table 2105 illustrated in FIG. 21B, to obtain composite characteristics as a combination of the W1 component banding characteristics and the W4 component banding characteristics. A table 2106 illustrated in FIG. 21C stores composite characteristics obtained in this manner.

Next, the correction information generation unit 36 calculates characteristic values of an inverted phase of the above described table 2106 and stores the calculated inverse characteristics in a table 2107. Then, the correction information generation unit 36 calculates density correction values based on inverse banding characteristic values stored in the table 2107 and stores the calculated density correction values in a table 2108. A method for generating the above described tables 2107 and 2108 is similar to the method described in the first exemplary embodiment. Therefore, a detailed description for the table generation method is not repeated.

As described in the third exemplary embodiment, the standard to be referred to in the formation of test patches is not limited to the phase of the W4 component. Any other standard that can directly or indirectly identify the phase of the W4 component can be appropriately employed.

[Regarding a Correction Method]

The correction according to the above described exemplary embodiment uses the inverse density characteristics so as to cancel the density unevenness induced by the rotational unevenness occurring in a motor. For example, in a case where the density is increased by the density unevenness, the image forming unit performs the correction to reduce the density. However, the correction according to the present invention is not limited to the one described in the above described exemplary embodiment. For example, it is useful to correct a centroid position of each scanning line image with the density so that deviation of a banding scanning line from an ideal position can be canceled, thereby quasi-correcting the position of the scanning line.

In this case, the density sensor 41 first detects the above described density unevenness of the W1 component and the density unevenness of the W4 component. The density unevenness and the rotational unevenness occurring in the motor 6 are in a predetermined phase relationship as described above. Then, the CPU 21 calculates a pitch interval between scanning lines according to a value of the density, using a conversion table. Namely, a correspondence between the pitch interval between scanning lines and the phase of the rotational unevenness occurring in the motor 6 can be obtained. Then, to set a pitch unevenness to have a quasi ideal interval, the centroid of an image is corrected according to a density variation of each scanning line.

[Regarding a Phase of Density Unevenness (a Phase of Rotational Unevenness Occurring in a Motor) at which Point is Based on to Generate Density Unevenness Correction Information]

Further, as described above, the phase of rotational unevenness occurring in a motor during an exposure operation is stored in association with density unevenness correction information in the EEPROM. However, the phase of rotational unevenness occurring in a motor during a transfer operation that is predicted when the exposure processing is performed, or the phase of rotational unevenness occurring in a motor at arbitrary timing after the exposure operation and before the transfer operation that is predicted when the exposure processing is performed, can be stored in association with the density unevenness correction information. In this case, the phase corresponding to the scanning line Ln that is determined in step S1704 illustrated in FIG. 16 or the phase to be used as a trigger for the exposure in step S1708 can be employed.

[Regarding Specifying of a Phase Change in a Motor 6]

As described above, in step S1713 illustrated in FIG. 17, the control unit 21 successively counts the FG count value (that corresponds to the FG signal), to detect a phase change of the rotational unevenness occurring in the motor 6. However, the method is not limited to the above described one. For example, if reproducibility is assured, an arbitrary or predetermined speed state of the motor 6 can be allocated to a specific phase of the motor 6 at time t3 in the timing chart illustrated in FIG. 7. A phase change of the motor 6 at an advanced phase can be identified based on a time elapsed since that time.

More specifically, if a period of time corresponding to one complete revolution of the motor 6 is constant or substantially constant, the FG count value can be associated with elapsed time. This can be recognized in a case where the above described FFT analysis unit is provided and the frequency analysis is performed on the FG signal. This can be also recognized in a case were the phase of the motor 6 at a specific time is referred to as a reference point. As described above, it is useful to allocate an arbitrary or predetermined phase to an arbitrary or predetermined speed state of the motor 6, so that the control unit 21 can identify a phase change of the motor 6 based on how much an operating parameter of a printer is advanced (or counted) from the speed state on which the phase is allocated.

[Regarding a Relative Phase Relationship Between a Phase of Density Unevenness and a Phase of Dark and Light Unevenness in a Test Patch Image]

The method for forming test patches including dark and light unevenness images that are differentiated in phase difference relative to the phase of density unevenness induced by the rotational unevenness occurring in the motor 6 is not limited to the above described method. Instead of employing the above described method for sequentially changing the phase of the dark and light unevenness image included in each test patch, the following method is employable in the present exemplary embodiment.

For example, the test patch generation unit 35 can fix, at a predetermined phase, the phase of the dark and light unevenness image included in a test patch. The test patch generation unit 35 can change the rotational unevenness occurring in the motor 6, which starts forming each test patch, in the same manner as the above described phase change of the dark and light unevenness image included in the test patch. The processing for detecting and analyzing each test patch having been formed can be executed in the same manner as in the above described exemplary embodiment and therefore detailed descriptions are not repeated.

[Regarding Density Information]

As described above, the control unit 21 receives an output voltage Vout (i.e. Vout1 or Vout2) from the density sensor 41. Then, the control unit 21 performs predetermined calculations to generate density information and performs various processing based on the generated density information. However, the density information is not limited to the above described one. For example, information that can directly indicate the light quantity, such as Vout illustrates FIG. 2, can be used as density information.

In this case, similar to the above described exemplary embodiments, the control unit 21 first executes the processing of the flowchart illustrated in FIG. 12 based on Vout. As the flowchart illustrated in FIG. 12 can obtain the amplitude of the density unevenness through the FFT analysis, the control unit 21 can obtain similar θmax, θmin, and θmid. Then, the control unit 21 generates exposure output correction tables similar to those illustrated in FIG. 14 based on the obtained values θmax, θmin, and θmid. Further, the control unit 21 can execute the exposure processing described with reference to the flowcharts illustrated in FIGS. 15 and 17. Further, in the second exemplary embodiment, the control unit 21 can execute processing based on Vout that is similar to the processing described with reference to FIG. 18. Further, in the third exemplary embodiment, the control unit 21 can similarly execute processing based on Vout. In this case, to generate the exposure output correction tables illustrated in FIG. 21A, it is necessary to calculate the density unevenness information stored in the table 1402 based on the unevenness of Vout. As described above, any parameter that represents the density unevenness can be employed as density information.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-224827 filed Sep. 29, 2009, which is, hereby incorporated by reference herein in its entirety.

What is claimed is:

1. An image forming apparatus comprising:

an image forming unit configured to form an image on a photosensitive member that is rotated by being driven by a motor;

a detection unit configured to detect density information when a plurality of test patches formed by the image forming unit is irradiated with light, wherein the plurality of test patches is formed based on image data, and the image data is used for forming the plurality of test patches having density unevenness in a predetermined period corresponding to density unevenness occurring due to rotational unevenness of the motor in the predetermined period in a sub-scanning direction of the image and being different in start phase of the density unevenness in the predetermined period; and a control unit configured to cause the image forming unit to form an image with density being corrected based on detection results of detecting the density information of the plurality of test patches.

2. The image forming apparatus according to claim 1, wherein the control unit is configured to cause the image forming unit to form an image with density being corrected based on a phase of density unevenness of a test patch having a largest output value in the detection results of detecting the density information of the plurality of test patches.

3. The image forming apparatus according to claim 1, wherein a period of the density unevenness is approximately less than or equal to a diameter of a light detection area of the detection unit.

4. The image forming apparatus according to claim 1, further comprising:

an exposure unit configured to expose the photosensitive member, wherein the control unit is configured to cause the exposure unit to expose the photosensitive member in an exposure amount corrected based on detection results of detecting the density information of the plurality of test patches.

5. The image forming apparatus according to claim 1, wherein the control unit is configured to cause the image forming unit to form an image with density being corrected based on a phase of density unevenness of a test patch having an intermediate value between a largest output value and a smallest output value in the detection results of detecting the plurality of test patches by the detection unit.

6. The image forming apparatus according to claim 1, wherein the control unit corrects image data formed by the image forming unit based on detection results of detecting the density information of the plurality of test patches.

7. The image forming apparatus according to claim 1, wherein the control unit is configured to cause the image forming unit to form an image with density being corrected based on a phase of density unevenness of a test patch having a smallest output value in the detection results of detecting the plurality of test patches.

8. The image forming apparatus according to claim 1, wherein the detection unit is configured to detect density unevenness of test patches having a period corresponding to a period of density unevenness occurring due to rotational unevenness of the motor in the predetermined period in the sub-scanning direction of the image, the density unevenness occurring due to rotational unevenness of the motor interfering with the density unevenness of the test patches.

9. The image forming apparatus according to claim 1, wherein the control unit is configured to cause the image forming unit to form an image with density or a position being corrected based on detection results of detecting the plurality of test patches.

10. A method for detecting density unevenness in an image forming apparatus, the method comprising:

forming, by an image forming unit configured to form an image on a photosensitive member that is rotated by being driven by a motor, a plurality of test patches based on image data, the image data being used for forming the plurality of test patches having density unevenness in a predetermined period corresponding to density unevenness occurring due to rotational unevenness of the motor in the predetermined period in a sub-scanning direction of the image and being different in start phase of the density unevenness in the predetermined period; and causing the image forming unit to form an image with density being corrected based on results of detection by a detection unit configured to detect density information when the plurality of test patches is irradiated with light.

11. An image forming apparatus comprising:

an image forming unit configured to form an image on a photosensitive member that is rotated by being driven by a motor;

a detection unit configured to detect density information when a plurality of test patches formed by the image forming unit is irradiated with light, wherein the plurality of test patches are formed based on image data used for forming the plurality of test patches having density unevenness in a predetermined period corresponding to density unevenness occurring due to rotational unevenness of the motor in the predetermined period in a sub-scanning direction of the image, and the plurality of test patches starts to be formed at different rotation phases of the motor; and a control unit configured to cause the image forming unit to form an image with density being corrected based on detection results of detecting the density information of the plurality of test patches.

12. A method for detecting density unevenness in an image forming apparatus, the method comprising:

forming, by an image forming unit configured to form an image on a photosensitive member that is rotated by being driven by a motor, a plurality of test patches based on image data used for forming the plurality of test patches having density unevenness in a predetermined period corresponding to density unevenness occurring due to rotational unevenness of the motor in the predetermined period in a sub-scanning direction of the image at different rotation phases of the motor; and causing the image forming unit to form an image with density being corrected based on results of detection by a detection unit configured to detect density information when the plurality of test patches is irradiated with light.

13. An image forming apparatus comprising:

an image forming unit configured to form an image on a photosensitive member that is rotated by being driven by a motor;

an instruction unit configured to cause the image forming unit to form a plurality of test patches composed of a plurality of dark and light images based on image data, the image data being used for forming the plurality of dark and light images in a predetermined period having phase differences different from a phase of density unevenness in a sub-scanning direction of an image, the density unevenness occurring due to rotation unevenness of the motor in a predetermined period;

a detection unit configured to detect density information when the plurality of test patches formed by the image forming unit is irradiated with light; and a control unit configured to cause the image forming unit to form an image with density being corrected based on detection results of detecting the density information of the plurality of test patches.

14. A method for detecting density unevenness in an image forming apparatus, the method comprising:

causing an image forming unit configured to form an image on a photosensitive member that is rotated by being driven by a motor to form a plurality of test patches composed of a plurality of dark and light images based on image data used for forming the plurality of dark and light images in a predetermined period having phase differences different from a phase of density unevenness in a sub-scanning direction of an image, the density unevenness occurring due to rotation unevenness of the motor in a predetermined period; and causing the image forming unit to form an image with density being corrected based on results of detection by a detection unit configured to detect density information when the plurality of test patches is irradiated with light.

* * * * *